US005653269A

United States Patent [19]

Miller et al.

[11] Patent Number: 5,653,269

[45] Date of Patent: *Aug. 5, 1997

[54] METHOD AND APPARATUS FOR MULTIPLE-CHANNEL DISPENSING OF NATURAL GAS

[76] Inventors: Charles E. Miller, 150 Seminole, Boulder, Colo. 80303; John F. Waers, 123 Snowmass Pl.; James A. Magin, 8983 Walker Rd., both of Longmont, Colo. 80503; Randal L. Custer, 566 Mt. Evans, Longmont, Colo. 80501; John T. Lopez, 6844 Twin Lakes Rd., Boulder, Colo. 80301

[ * ] Notice: The term of this patent shall not extend beyond the expiration date of Pat. No. 5,238,030.

[21] Appl. No.: 472,991

[22] Filed: Jun. 7, 1995

Related U.S. Application Data

[63] Continuation of Ser. No. 400,282, Mar. 3, 1995, Pat. No. 5,597,020, which is a continuation of Ser. No. 155,169, Oct. 27, 1993, abandoned, which is a continuation of Ser. No. 858,143, Mar. 27, 1992, Pat. No. 5,259,424, which is a continuation-in-part of Ser. No. 722,494, Jun. 27, 1991, Pat. No. 5,238,030.

[51] Int. Cl.[6] ..... B65B 31/00

[52] U.S. Cl. ..... 141/4; 141/83; 141/18

[58] Field of Search ..... 141/2–4, 18, 21, 141/83, 94, 95, 98

[56] References Cited

U.S. PATENT DOCUMENTS

| | | | |
|---|---|---|---|
| 3,278,728 | 10/1966 | Ragsdale | 235/151.34 |
| 3,817,100 | 6/1974 | Anderson et al. | 73/213 |
| 3,875,955 | 4/1975 | Gallatin et al. | 137/14 |
| 4,466,290 | 8/1984 | Frick | 73/756 |
| 4,483,376 | 11/1984 | Bresie et al. | 141/95 |
| 4,527,600 | 7/1985 | Fisher et al. | 141/4 |
| 4,562,744 | 1/1986 | Hall et al. | 73/861.02 |
| 4,646,940 | 3/1987 | Kramer et al. | 222/1 |
| 4,649,760 | 3/1987 | Wedding | 73/863.23 |
| 5,029,622 | 7/1991 | Mutter | 141/4 |
| 5,135,002 | 8/1992 | Kirchner et al. | 128/672 |
| 5,209,258 | 5/1993 | Sharp et al. | 137/343 |
| 5,317,930 | 6/1994 | Wedding | 73/863.03 |

OTHER PUBLICATIONS

Shaprio, Ascher H., "The Dynamics and Thermodynamics of Compressible Fluid Flow," vol. One, New York.

Durgin, William W., "FLOW, Its Measurement and Control in Science and Industry," vol. Two, 1981, St. Louis.

*Primary Examiner*—J. Casimer Jacyna

*Attorney, Agent, or Firm*—James R. Young; Chrisman, Bynum & Johnson, P.C.

[57] ABSTRACT

A supply plenum connected to a source of compressed natural gas (CNG) and a control valve assembly for selectively turning on the flow of CNG through a sonic nozzle and out through a dispensing hose assembly. Pressure and temperature transducers connected to the supply plenum measure the stagnation pressure and temperature of the CNG and the ambient temperature, and a pressure transducer fluidically connected to the vehicle tank via the dispensing hose assembly monitors the pressure of the CNG in the vehicle tank. An electronic control system connected to the pressure and temperature transducers and to the control valve assembly calculates a vehicle tank cut-off pressure based on the ambient temperature and on the pressure rating of the vehicle tank that has been pre-programmed into the electronic control system, calculates the volume of the vehicle tank and the additional mass of CNG required to increase the tank pressure to the cut-off pressure, and automatically turns off the CNG flow when the additional mass has been dispensed into the vehicle tank. The electronic control system also determines the amount of CNG dispensed through the sonic nozzle based on the upstream stagnation temperature and pressure of the CNG and the length of time the CNG was flowing through the sonic nozzle.

6 Claims, 12 Drawing Sheets

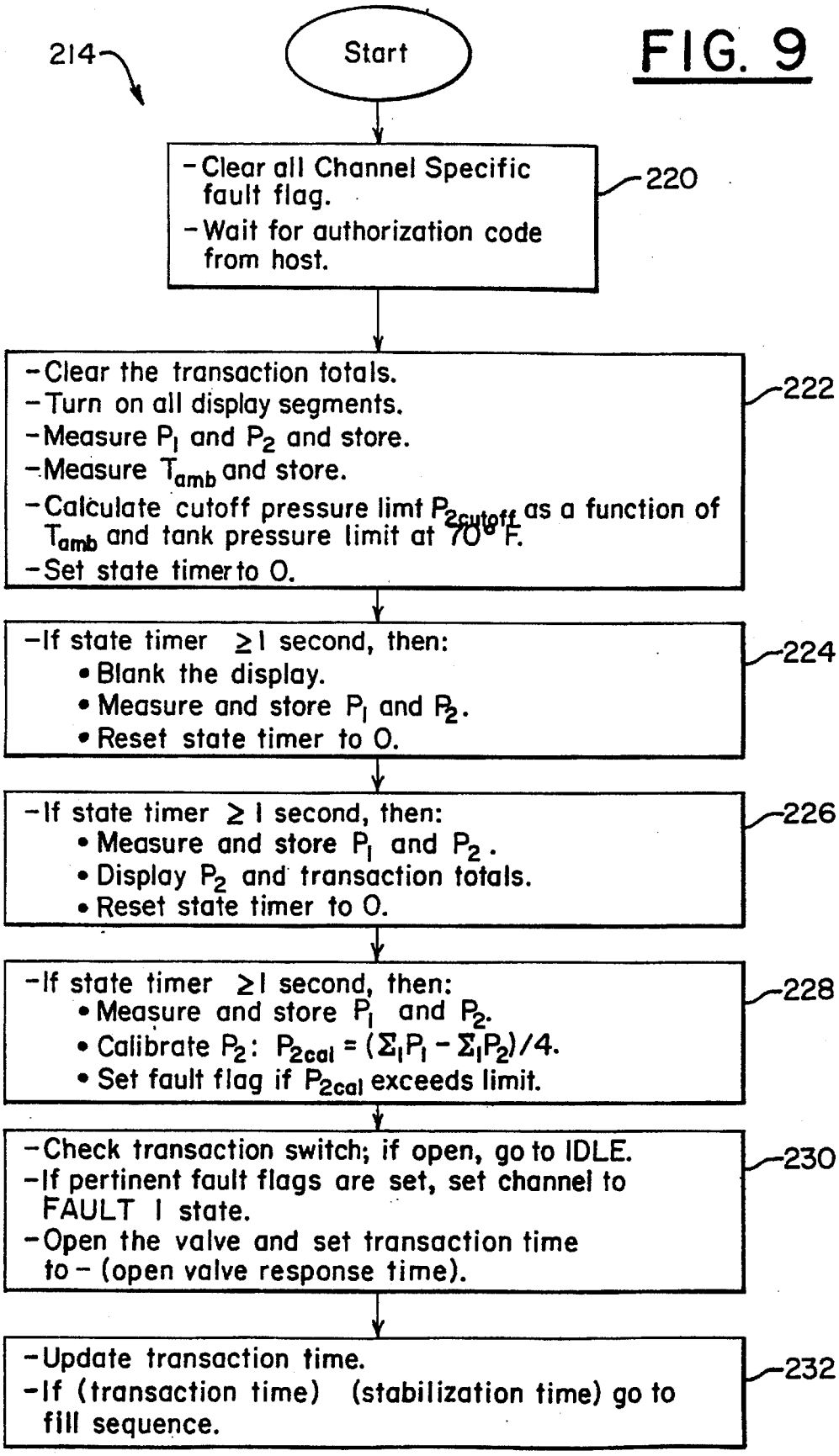
214
Start
FIG. 9
- Clear all Channel Specific fault flag.
- Wait for authorization code from host.
220
- Clear the transaction totals.
- Turn on all display segments.
- Measure $P_1$ and $P_2$ and store.
- Measure $T_{amb}$ and store.
- Calculate cutoff pressure limt $P_{2cutoff}$ as a function of $T_{amb}$ and tank pressure limit at 70° F.
- Set state timer to 0.
222
- If state timer ≥1 second, then:
• Blank the display.
• Measure and store $P_1$ and $P_2$.
• Reset state timer to 0.
224
- If state timer ≥ 1 second, then:
• Measure and store $P_1$ and $P_2$.
• Display $P_2$ and transaction totals.
• Reset state timer to 0.
226
- If state timer ≥1 second, then:
• Measure and store $P_1$ and $P_2$.
• Calibrate $P_2$: $P_{2cal} = (\Sigma_1 P_1 - \Sigma_1 P_2)/4$.
• Set fault flag if $P_{2cal}$ exceeds limit.
228
- Check transaction switch; if open, go to IDLE.
- If pertinent fault flags are set, set channel to FAULT 1 state.
- Open the valve and set transaction time to - (open valve response time).
230
- Update transaction time.
- If (transaction time) (stabilization time) go to fill sequence.
232

METHOD AND APPARATUS FOR MULTIPLE-CHANNEL DISPENSING OF NATURAL GAS

This application is a continuation of application Ser. No. 08/400,282, filed Mar. 3, 1995, now U.S. Pat. No. 5,597,020, which is a continuation of 08/155,169 filed on Oct. 27, 1993, now abandoned, which is a continuation of 07/858,143, filed on Mar. 27, 1992, now U.S. Pat. No. 5,259,424, which is a continuation-in-part of 07/7232,494, filed on Jun. 27, 1991, now U.S. Pat. No. 5,238,030.

BACKGROUND OF THE INVENTION

1. Field of the Invention

This invention relates generally to methods and apparatus for measuring and controlling fluid flow rates and, more particularly, to a method and apparatus for dispensing natural gas.

2. Brief Description of the Prior Art

Over the past few years, there has been a steadily increasing interest in developing alternative fuels for automobiles in an effort to reduce the harmful emissions produced by conventional gasoline and diesel powered vehicles. One such alternative fuel that has already been used with favorable results is compressed natural gas (CNG). Besides being much cleaner burning than gasoline or diesel fuel, most modern automobiles can be converted to operate on compressed natural gas (CNG). Typically, such a conversion may include various minor modifications to the engine and fuel delivery system and, of course, the installation of a natural gas fuel tank capable of storing a sufficient amount of CNG to provide the vehicle with range and endurance comparable to that of a conventionally fueled vehicle. In order to provide a reasonably sized storage tank, the CNG is usually stored under relative high pressures, such as 3,000 to 4,000 pounds per square inch gauge (psig).

While the conversion process described above is relatively simple, the relatively high pressure under which the CNG is stored creates certain refueling problems that do not exist for conventional vehicles powered by liquid fuels, such as gasoline. Obviously, since the gas is transferred and stored under high pressure, special fittings, seals, and valves have to be used when the CNG is transferred into the CNG storage tank on the vehicle to prevent loss of CNG into the atmosphere. Also, special precautions must be taken to minimize the range of fire or explosion that could result from the unwanted escape of the high pressure CNG. Accurate, yet convenient and easy to use measurement of the amount of CNG delivered into the vehicle's storage tank is also a problem. Consequently, most currently available natural gas refueling systems require that several relatively complex steps be performed during the refueling process to prevent leakage, minimize the risk of fire or explosion, and to measure the amount of fuel delivered. Unfortunately, because such processes tend to be relatively complex, they cannot be carried out very easily by most members of the general public or even by unskilled workers. Therefore, most CNG dispensing systems usually required trained personnel to perform the refueling process. As of date, providing trained operators to perform the refueling operation has not yet posed a significant problem, because natural gas refueling stations are generally limited to fleet operators of vehicles who can afford to have trained personnel to perform the refueling operations and who either do not care to keep accurate measurements of each vehicle fill-up or who can afford complex flow measuring equipment to do it.

However, because the interest in natural gas powered automobiles is increasing rapidly, there is a growing need to develop a natural gas refueling system that is highly automated and has sufficient fail-safe systems to minimize the danger of fire or explosion, while at the same time being capable of accurate measurements and being used safely by the general public. Ideally, such a natural gas dispensing system should be as familiar to the customer and as easy to use as a conventional gasoline pump and refueling station.

As mentioned above, there are several natural gas dispensing "pumps" currently available. One such system is disclosed in the patent to Fisher et al., U.S. Pat. No. 4,527,600. While the dispensing system disclosed by Fisher et al., is relatively easy to use, it requires certain relatively expensive components. For example, Fisher's dispensing system utilizes differential pressure transducers to determine the amount of CNG that is dispensed into the vehicle tank. Disadvantageously, however, such differential pressure transducers are expansive, and have a rather limited range of operation of about 3 to 1.

Another significant problem associated with the dispensing systems currently available, such as the system disclosed by Fisher, et al., is that such systems cannot determine accurately when the natural gas storage tank in the vehicle is filled to rated capacity, yet not overfilled. That is, since natural gas storage tanks in vehicles have to be rated to safely contain CNG under a given pressure at a given temperature (e.g., 3000 psig at a temperature of 70° F., the "standard temperature"), it is important to determine the correct pressure to which the tank should be filled when the ambient temperature is not exactly 70° F. For example, if the ambient temperature is warmer than the standard temperature of 70° F., the tank can be filled safely to a pressure higher than the rated pressure. In fact, the tank will not be completely filled under such warmer temperature circumstances until it is at such a higher pressure. Conversely, if the ambient temperature is below standard temperature, the tank cannot be filled safely to the rated pressure, because as the CNG warms to the standard temperature, the pressure would exceed the rated pressure. In that situation, the tank would be overfilled, and there could be a significant danger of the safety relief valve on the tank venting the excess CNG to the atmosphere, thereby losing the CNG and possibly even creating an explosion hazard. Worse yet, the tank could actually rupture if the safety valve malfunctioned.

Another problem relates to accurately sensing the vehicle tank pressure while the vehicle tank is being filled. For example, it is impossible to sense the vehicle tank pressure with a remotely located pressure sensor if the CNG flow through the dispensing hose reaches sonic velocity at some point between the pressure sensor and the vehicle tank itself. Typically, such a choke point occurs in the safety check valve located in the vehicle tank coupler assembly. Accordingly, such dispensing pumps are usually designed to ensure that the flow of CNG between the remote pressure sensor for sensing the vehicle tank pressure and the vehicle tank itself remains subsonic at all times and under all flow conditions, which, of course, limits the maximum delivery rate of the pump. Unfortunately, even if the dispensing pump is designed to ensure that a sonic choke point does not occur between the pressure sensor and the tank, it is still necessary to compensate for pressure errors due to the pressure drop in the hose and coupler/check valve assembly, which is difficult, since the pressure drop in the vehicle check valve may vary depending on the characteristics of particular valve.

Therefore, there is a need for a natural gas dispensing system that provides the desired degree of safety for dispensing natural gas under high pressures that is preferably as easy to use a conventional gasoline pump. Such a dispensing system should be relatively simple and reliable and ideally would not require expensive and complex differential pressure transducers. Most importantly, such a dispensing system should be capable of automatically determining a temperature corrected cut-off pressure to ensure that the vehicle storage tank is completely filled regardless of the ambient temperature and regardless of whether the CNG flows through a sonic choke point in the dispensing hose or coupler/check valve assembly. Finally, it would be desirable for such a dispensing system to accommodate two or more dispensing hoses from a single supply plenum to reduce the number of pressure and temperature sensors to a minimum, thus providing better overall system reliability and lower cost.

SUMMARY OF THE INVENTION

Accordingly, it is a general object of this invention to provide a pressurized fluid dispensing system that can automatically compensate for non-standard ambient gas temperature to promote complete filling of a pressurized storage tank.

It is a further general object of this invention to provide a pressurized fluid dispensing system that can accurately fill a pressurized storage tank to its rated capacity even though the flow of CNG through the dispensing hose passes through a sonic choke point.

It is another general object of the is invention to provide a pressurized fluid dispensing system that can accurately measure the amount of fluid transferred into a pressurized storage tank without the need to resort to expensive and performance limiting differential pressure transducers and regardless of whether the CNG in the dispensing hose flows through a sonic choke point.

It is another object of this invention to provide a pressurized fluid dispensing system that uses sonic nozzles to measure the amount of fluid dispensed.

It is a more specific object of this invention to provide a natural gas dispensing system that is highly automated and simple to use while providing a high degree of safety.

It is yet another more specific object of this invention to provide a natural gas dispensing system that can easily support multiple dispensing hoses from a single supply plenum.

Additional objects, advantages, and novel features of the invention shall be set forth in part in the description that follows, and in part will become apparent to those skilled in the art upon examination of the foregoing or may be learned by the practice of this invention. The objects and advantages of the invention may be realized and attained by means of the instrumentalities and in combinations particularly pointed out in the appended claims.

To achieve the foregoing and other objects, and in accordance with the purpose of the present invention, as embodied and broadly described herein, the natural gas dispensing system according to this invention may comprise a supply plenum connected to a CNG source and a control valve assembly for selectively turning on the flow of CNG through a sonic nozzle and cut through a dispensing hose assembly. Pressure and temperature transducers connected to the supply plenum measure the stagnation pressure and temperature of the CNG and a pressure transducer fluidically connected to the vehicle tank via the dispensing hose assembly is used to determine the discharge pressure. A second temperature transducer is used to measure the ambient temperature. An electronic control system connected to the pressure and temperature transducers and to the control valve assembly calculates a vehicle tank cut-off pressure based on the ambient temperature and on the pressure rating of the vehicle tank that has been pre-programmed into the electronic control system, calculates the volume of the vehicle tank and the additional mass of CNG required to increase the tank pressure to the cut-off pressure, and automatically turns off the CNG flow when the additional mass has been dispensed into the vehicle tank. The electronic control system also determines the amount of CNG dispensed through the sonic nozzle based on the upstream stagnation temperature and pressure of the CNG and the length of time of CNG was flowing through the sonic nozzle. A calibration system is provided to ensure accurate pressure measurements and relative pressure measurements.

The method of this invention includes the steps of connecting a CNG supply tank and the vehicle tank with a pressure tight dispensing hose, sensing the ambient temperature before initiating the dispensing cycle, and calculating a cut-off pressure for the vehicle tank based on the ambient temperature and based on the pressure rating for the vehicle tank. Upstream and downstream pressure sensors on opposite sides of the sonic nozzle can be calibrated by equalizing pressure in the system for both sensors, taking measurements from a both sensors, and then adding any difference between the passive measurements to subsequent pressure measurements from one of the sensors. The dispensing cycle is then initiated by briefly cycling the valve to pop open the vehicle tank check valve and equalize the pressure in the dispensing hose and the vehicle tank and sensing the initial vehicle tank pressure. Next, a predetermined mass of CNG is dispensed into the vehicle storage tank to increase the tank pressure to an intermediate pressure. The initial and intermediate tank pressures are then used to determine the volume of the vehicle tank. Well-known gas relations are then used to calculate the mass of CNG required to fill the vehicle tank to the temperature compensated cut-off pressure and the dispenser then fills the tank with the calculated mass of CNG.

BRIEF DESCRIPTION OF THE DRAWINGS

The accompanying drawings, which are incorporated herein and form a part of this specification, illustrate the preferred embodiment of the present invention, and together with the description, serve to explain the principles of the invention. In the drawings:

FIG. 9 is a flow chart showing the detailed steps of the Start Sequence shown in FIG. 8;

FIG. 10(*b*) is a continuation of FIG. 10(*a*); and

DETAILED DESCRIPTION OF THE PREFERRED EMBODIMENT

Figure 1:
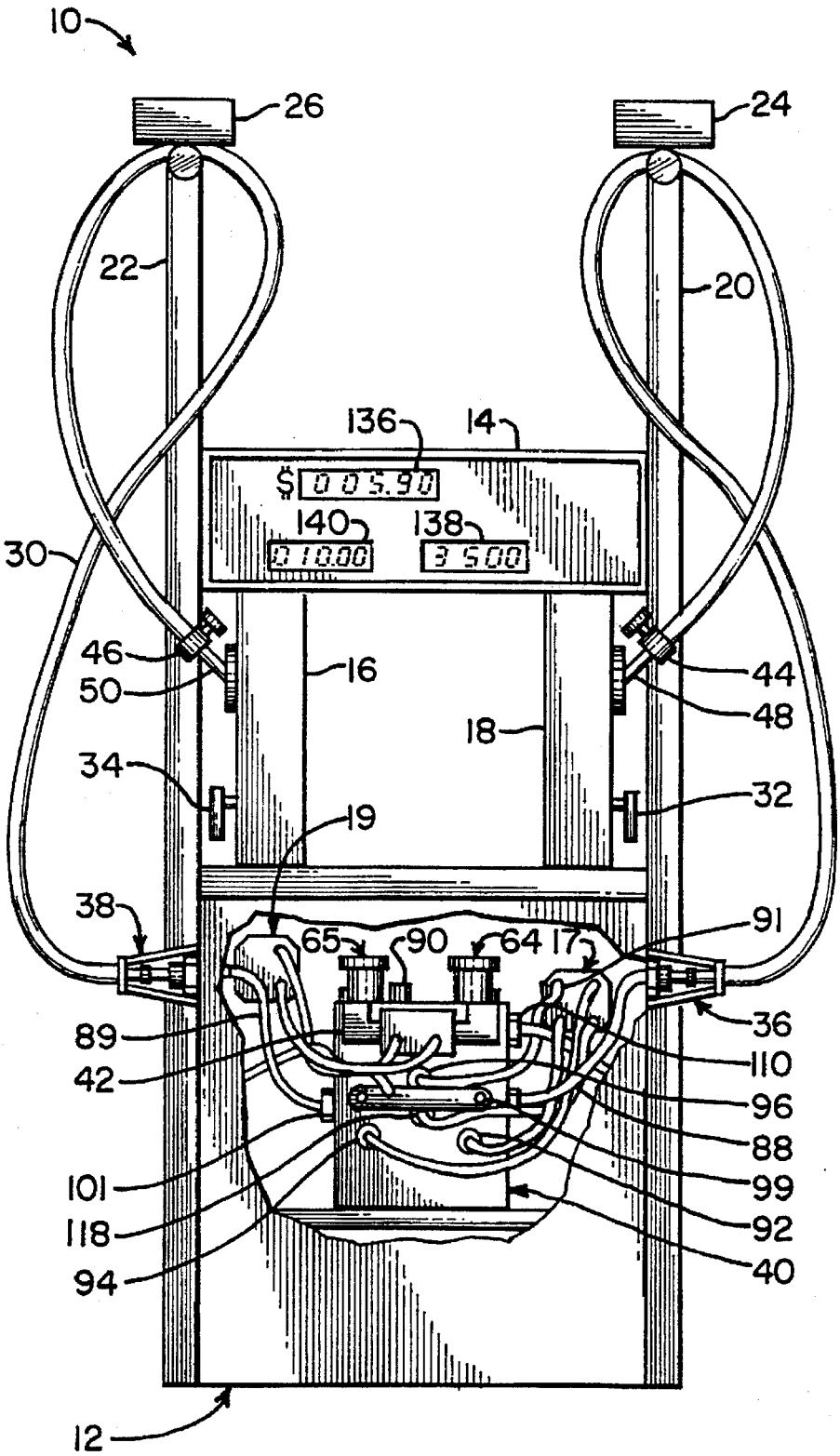
FIG. 1 is a front view in elevation of the natural gas dispensing system according to the present invention with the front panel of the lower housing broken away to show the details of the natural gas supply plenum and valve body assembly, and with the front cover of an electrical junction box broken away to show the location of the ambient temperature sensor.

The major components of the natural gas dispensing system 10 according to the present invention are best seen in FIG. 1 and comprise a lower housing 12 which houses the supply plenum and valve body assembly 40, along with numerous associated components, as will be described in detail below. The electrical wires from the various pressure and temperature transducers 92, 94, 96, and 58 as well as from the solenoid valve assembly 42 are routed to two sealed electrical junction boxes 17 and 19, respectively, via pressure-tight conduit to reduce the chances of fire or explosion. Electrical wires from these two junction boxes 17, 19 are then routed in pressure-tight conduit to an elevated and pressurized penthouse 14 which houses the electronic control system (not shown in FIG. 1) and various display windows 136, 138, and 140. Penthouse 14 is mounted to the lower housing 12 by left and right penthouse support members 16, 18. Two vertical hose supports 20, 22 are attached to either side of lower housing 12 and penthouse 14 and support the two retrieving cable assemblies 24, 26, as well as a first dispensing hose 28 and a second dispensing hose 30, respectively. These first and second dispensing hoses 28, 30 are connected to the supply plenum and valve body assembly 40 via two breakaway connectors 36, 38 and two natural gas output lines 88 and 89. Finally, each dispensing hose 28, 30 terminates in respective three-way valve assemblies 44, 46 and pressure-tight hose couplers 48, 50. Each pressure-tight hose coupler is adapted to connect its respective dispensing hose to the natural gas storage tank coupler on the vehicle being refueled (not shown).

The high degree of automation of the dispensing system 10 allows it to be easily and safely used on a "self serve" basis, much like conventional gasoline pumps, although the system could also be operated by a full-time attendant. In order to dispense the CNG into the vehicle tank, a dispensing hose, such as dispensing hose 28, is connected to the vehicle tank being refueled via pressure-tight coupler 48, which is adapted to fit with the standardized connector on the vehicle. The customer or attendant would then move the three-way valve 44 to the "fill" position and move the transaction switch 32 to the "on" position. The natural gas dispensing pump 10 then begins dispensing CNG into the vehicle tank, continuously indicating the amount of natural gas being dispensed on display 140, the price on display 136, and the pressure in the vehicle tank on display 138 (after a finite delay and under no flow conditions), much like a conventional gasoline pump. After the vehicle tank has been filled to the proper pressure, as determined by the ambient temperature sensed by temperature transducer 91 located within junction box 17, the dispensing system 10 automatically shuts off the flow of CNG into the vehicle, as will be described in detail below. The customer or attendant would then move transaction switch 32 to the "off" position, and turn the three-way valve to the "vent" position to vent the natural gas trapped in the space between the hose coupler 48 and the vehicle coupler (not shown) into a vent recovery system (not shown), where it is re-compressed and pumped back into the CNG storage tank (also not shown).

The supply plenum and valve body assembly 40, along with the electronic control system (not shown in FIG. 1, but shown in FIG. 6 and fully described below) forms the heart of the natural gas dispensing system 10 and includes sonic nozzles, digital control valves, and various pressure and temperature transducers to automatically dispense the exact amount of natural gas required to completely fill the vehicle storage tank as well as to automatically calculate and display the total amount of natural gas dispensed into the storage tank. Since the CNG dispensed by the system 10 is under considerable pressure (about 4,000 psig), the dispensing system 10 also includes a number of fail-safe and emergency shut-off features to minimize or eliminate any chance of fire or explosion, as will be described below.

A significant advantage of the natural gas dispensing system 10 is that it does not require performance limiting and complex differential pressure transducers to determine the amount of CNG dispensed into the vehicle storage tank. Advantageously, the present invention can accurately measure the amount of CNG dispensed using relatively inexpensive and simple gauge pressure transducers, as will be discussed below.

Yet another advantage of the natural gas dispensing system 10 is that a plurality of sonic nozzles can be connected to a single input or supply plenum, each of which may be operated independently of the others without adversely affecting the metering accuracy or performance of the other nozzles. Accordingly, the preferred embodiment utilizes two sonic nozzles and two control valve assemblies, so that two dispensing hoses can be easily used in conjunction with the single supply plenum and valve body assembly 40, whereby increasing utility and reducing cost. Furthermore, because more than one sonic nozzle can be connected to the single supply plenum, only a single set of pressure and temperature transducers are required to sense the stagnation pressure and stagnation temperature of the CNG contained within the supply plenum, even though two or more hoses or "channels" are connected to the single plenum, thereby further reducing the cost and complexity of the dispensing system 10.

Perhaps the most significant feature of the present invention is that the CNG dispensing system 10 is temperature compensated to automatically fill the vehicle natural gas tank to the correct pressure regardless of whether the ambient temperature is at the "standard" temperature of 70° F. For example, if the ambient temperature is above standard, say 100° F., the vehicle tank will be automatically filled to a pressure greater than its rated pressure at standard temperature, since, when the CNG in the tank cools to the standard temperature, the pressure will decrease to the rated pressure of the tank. The dispensing system 10 automatically determines the proper cut-off pressure for the ambient temperature and automatically terminates the refueling process when the calculated cut-off pressure is reached. Such automatic temperature compensation, therefore, ensures that the vehicle storage tank is filled to capacity regardless of the ambient temperature.

Another significant feature of the present invention is that it does not rely on a pressure sensor to determine the pressure of the vehicle tank during the filling process. Instead, the CNG pump according to the present invention first determines the volume of the vehicle storage tank and then computes the mass of CNG required to fill the vehicle tank to the previously determined, temperature compensated cut-off pressure. Therefore, the present invention eliminates the need for continuously sensing the vehicle tank pressure, avoids the problems associated with pressure losses in the dispensing hose and coupler/check valve assembly, and is accurate even if a sonic choke point exists in the interconnecting dispensing hose or coupler assembly.

Figure 2:
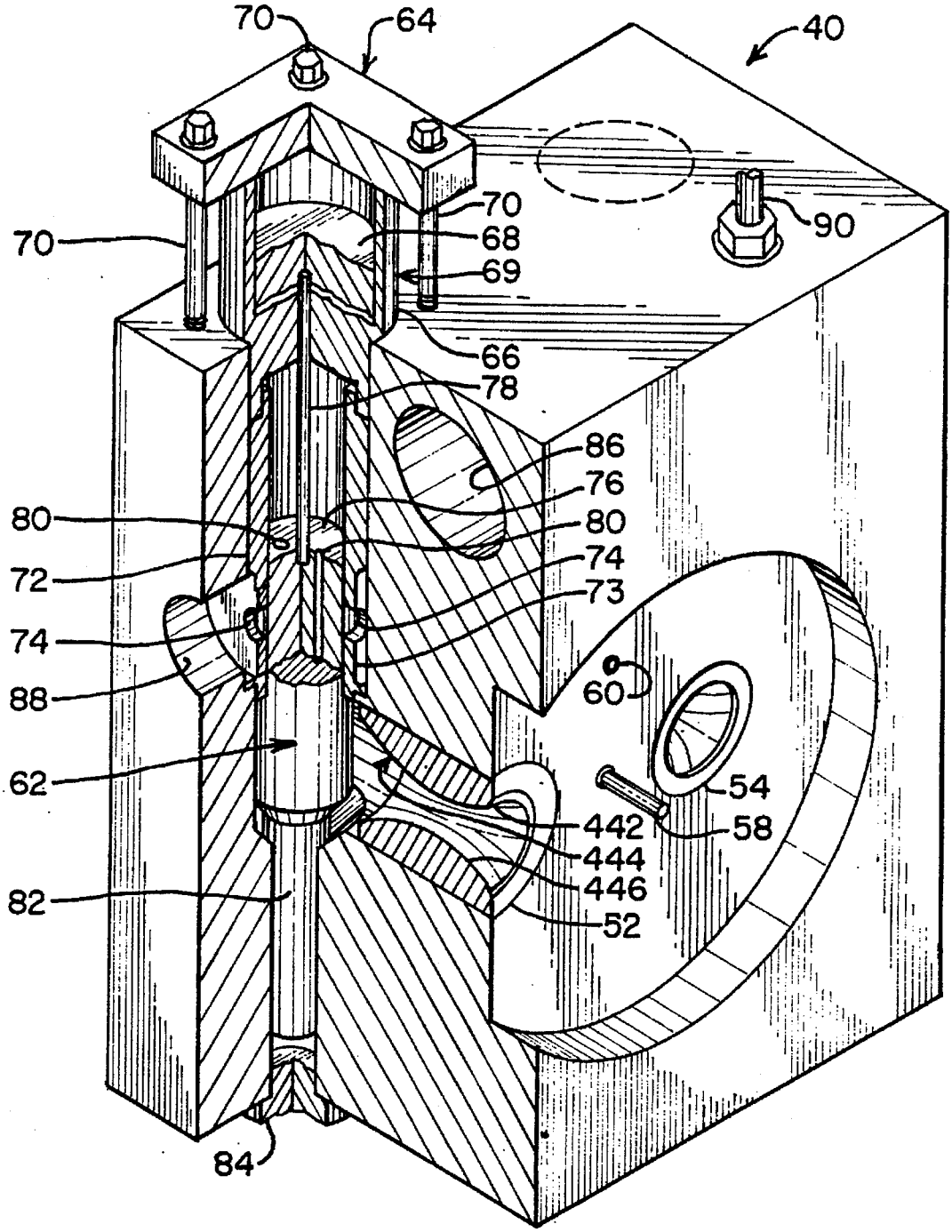
FIG. 2 is a perspective view of the supply plenum and valve body assembly shown in FIG. 1 with the supply plenum cover removed and with a corner section broken away to reveal the details of the sonic nozzle, the control valve assembly, and the pneumatic air reservoir.
Figure 3:
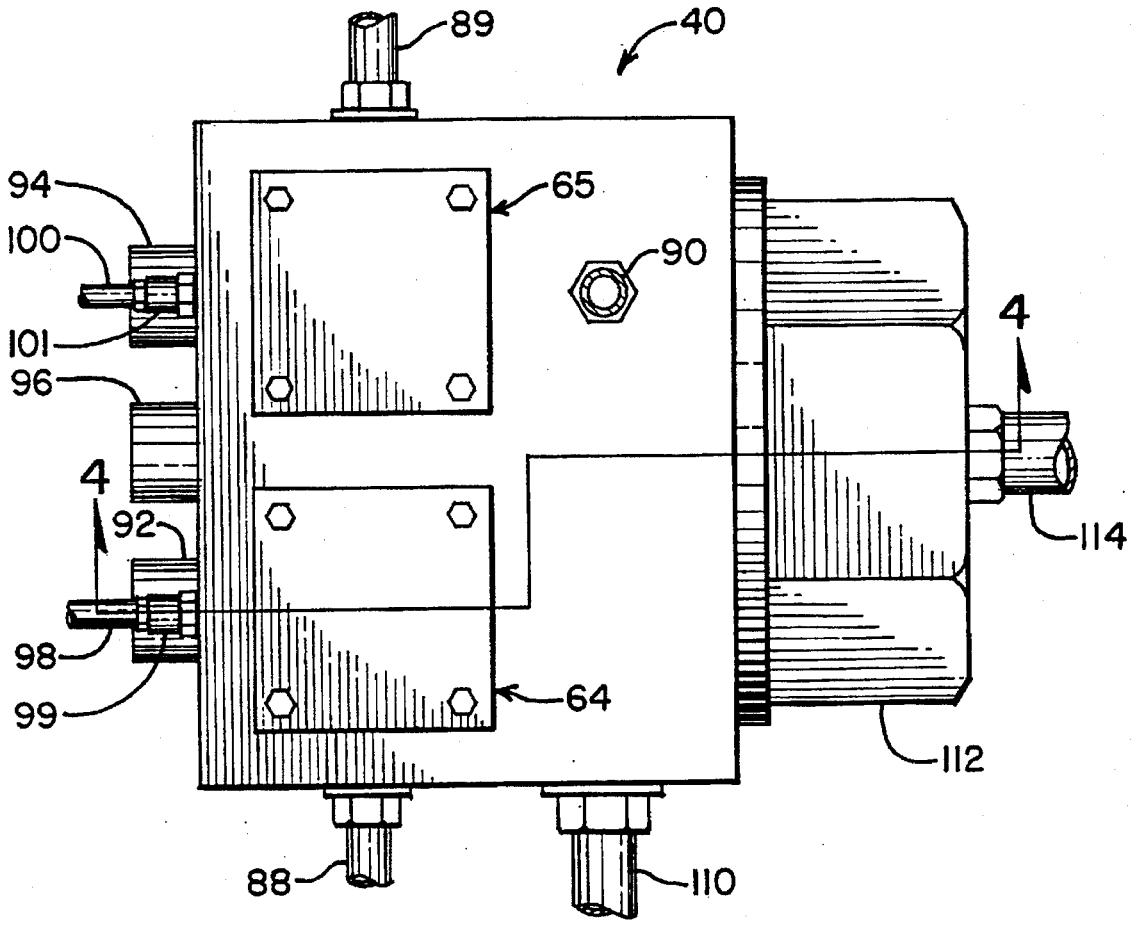
FIG. 3 is a plan view of the supply plenum and valve body assembly of the present invention showing the plenum chamber cover in position, the various inlet and outlet connections, and the various pressure and temperature transducers used to sense the pressures and temperatures of the CNG at various points in the plenum and valve body assembly.
Figure 4:
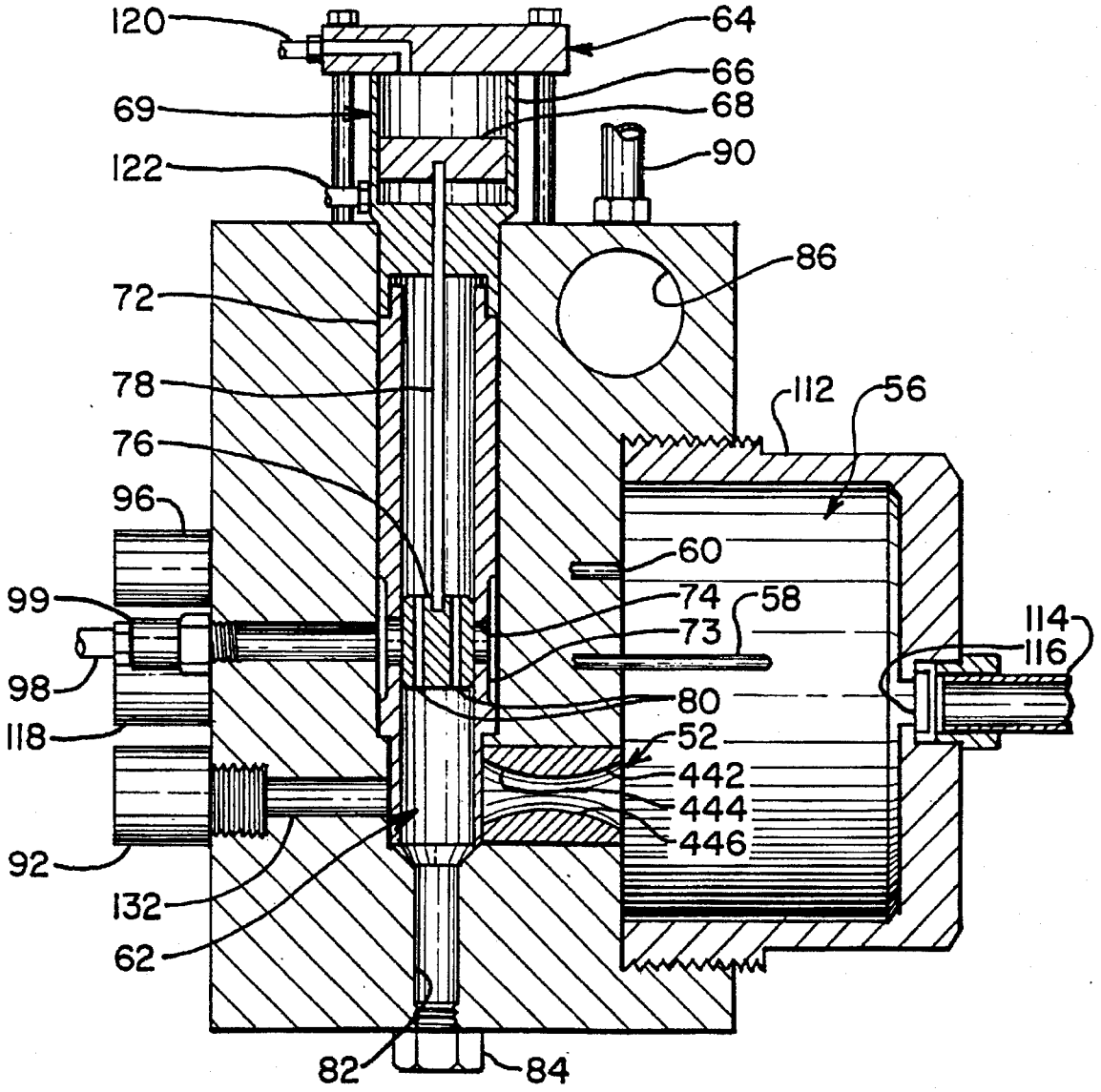
FIG. 4 is a sectional view in elevation of the supply plenum and valve body assembly taken along the line 4—4 of FIG. 3 more clearly showing the details of the plenum chamber cover, the supply plenum, one of the sonic nozzles, the corresponding control valve assembly, and the positioning of the various pressure and temperature transducers.

The details of the supply plenum and valve body assembly 40 are best seen and understood by referring to FIGS. 2, 3 and 4 simultaneously. As described above, the preferred embodiment includes two separate and independent nozzle, valve, and hose assemblies, which may be referred to hereinafter as channels. However, to simplify the description, only the first channel i.e., the channel for hose 28 will be described in complete detail. The components utilized by the second channel (hose 30) are identical in every respect, and, therefore, will not be described in detail.

In the preferred embodiment, the supply plenum and valve body assembly 40 is machined from a single block of aluminum, although other materials could be used just as easily. Supply plenum and valve body assembly 40 defines, in combination with the plenum chamber cover 112, a supply plenum 56, (see FIGS. 3 and 4) and a pneumatic reservoir 86, and also houses the two sonic nozzles 52, 54 and the corresponding control valve assemblies 64, 65. Various pressure transducers 92, 94, and 96 and temperature transducer 118, as well as the solenoid valve assembly 42 (shown in FIG. 1, but not shown in FIGS. 2, 3, and 4 for clarity), are also mounted to the supply plenum and valve body assembly 40, as will be described below. Pressures required for the processes required below may be obtained by any method or apparatus known to persons skilled in this art.

As mentioned above, the natural gas dispensing system 10 of the present invention utilizes sonic nozzles to accurately meter the flow of CNG through each dispensing hose. Such sonic nozzles have been used for decades as flow regulators because the mass flow rate of a gas flowing through such a nozzle is independent of the back pressure at the nozzle exit, so long as the gas is flowing at sonic velocity in the throat section of the nozzle. Put in other words, the metering accuracy is not affected by variations in the vehicle tank pressure. Therefore, sonic nozzles eliminate the need to measure both the upstream and downstream pressures of the gas in order to determine the gas flow rate.

Briefly, a sonic nozzle, such as the sonic nozzle 52, comprises a converging section 442 and a diverging section 444 separated by a throat section 446, which represents that portion of the nozzle 52 having the smallest cross-sectional area. Gas entering the converging or inlet section 442 of sonic nozzle 52 is accelerated until it is flowing at the speed of sound in the throat section 446, provided there is a sufficiently high pressure ratio between the "upstream" pressure (i.e. The pressure of CNG in the supply plenum 56) and the "downstream" pressure (i.e., the pressure in the intermediate chamber 62). If the diverging section 444 is properly designed in accordance with well-known principles, the gas will decelerate in the diverging section 444 until nearly all of the velocity pressure has been converted back into static pressure before the gas enters the downstream or intermediate chamber 62. A significant feature of the sonic nozzle 52 is that for a given set of stagnation pressures and temperatures of the fluid upstream of the nozzle 52, there is a maximum flow which can be forced through the nozzle 52 that is governed by the area of throat section 446. No matter what happens downstream from the throat section 446 in the way of decreasing the pressure or increasing the flow area, the flow rate will remain the same, so long as sonic conditions are maintained at the throat section 446. Accordingly, the mass flow rate through the sonic nozzle 52 is governed by the following equation:

$$\dot{m} = C_d \frac{kAp_1}{\sqrt{T_1}} \tag{1}$$

where $\dot{m}$ is the mass flow rate of the fluid flowing through the nozzle; $C_d$ is the nozzle discharge coefficient for the particular nozzle being used; k is a constant depending on the ratio of specific heats and the gas constant of the fluid; $p_1$ is the stagnation pressure of the fluid in the supply plenum 56; A is the nozzle throat area; and $T_1$ is the absolute temperature of the fluid in the supply plenum 56. Reference is made to the text, *The Dynamics and Thermodynamics of Compressible Fluid Flow*, by Ascher H. Shapiro, Volume 1, page 85, equation (4,17), the Ronald Press Co., New York, 1953, for the exact relationship between k, the ratio of specific heats, and the gas constant. The flow rate through the sonic nozzle 52 is, therefore, proportional to the stagnation pressure $p_1$ in the supply plenum 56 divided by the square root of the stagnation temperature $T_1$ in supply plenum 56 times the effective throat area of the sonic nozzle 52. It follows that the fluid flow rate determinative parameter is the stagnation pressure $p_1$ in the plenum 56 divided by the square root of the stagnation temperature $T_1$ in plenum 56. This linear relationship is maintained so long as the fluid flowing through the nozzle 52 remains sonic at the throat section 446, which eliminates any dependence of flow rate upon the pressure in the downstream or intermediate chamber 62 (see FIG. 2). Further, proper design of such a sonic nozzle will allow the velocity in the throat to reach sonic velocity or "choke" at reasonably small pressure ratios of about 1.05 or 1.1. That is, the pressure $p_1$ of the fluid in the supply plenum 56 need only be about 5 to 10 percent higher than the pressure $p_2$ in the intermediate or downstream chamber 62 to achieve and maintain sonic velocity in the throat section 446.

If the pressure ratio between the stagnation pressure $p_1$ in supply plenum 56 and the stagnation pressure $p_2$ in the intermediate (i.e. discharge) chamber 62, is not sufficient to sustain sonic velocity through the throat section 446 of the nozzle, then the flow rate through the nozzle 52 is dependent on the upstream stagnation temperature and pressure ($T_1$ and $p_1$) as well as the downstream stagnation pressure $p_2$, and the equation listed above becomes a function of the downstream stagnation pressure, thus:

$$\dot{m} = C_d \frac{kAp_1}{\sqrt{T_1}} f\left(\frac{p_1 - p_2}{p_1}\right) \quad (2)$$

where $\dot{m}$ is the mass flow rate of the fluid passing through the nozzle; $C_d$ is the nozzle discharge coefficient for the particular nozzle being used; k is a constant depending on the ratio of specific heats and the gas constant of the fluid; $p_1$ is the stagnation pressure of the fluid in the supply plenum 56; A is the nozzle throat area; $T_1$ is the absolute temperature of the fluid in the supply plenum 56; and $p_2$ is the stagnation discharge pressure.

Referring back to FIGS. 2, 3, and 4, simultaneously, the flow of natural gas through the sonic nozzle 52 is controlled by a "digital" valve assembly 64 for the first dispensing hose 28 as shown in FIG. 1. The valve assembly 64 is referred to as a digital valve because it has only two positions—on and off. There are no intermediate positions typically associated with analog-type valves. As mentioned above, there is an identical sonic nozzle 54 and digital valve assembly 65 for the second channel, i.e., hose 30, as shown in FIG. 1.

The digital valve assembly 64 for the first channel is oriented at right angles to the sonic nozzle 52 so that an intermediate or downstream chamber 62 is defined in the area between the downstream section of the nozzle 52 and the valve body assembly 64. A vertical condensate leg 82 extends downwardly from the intermediate or downstream chamber 62 to collect any condensate from the CNG as it flows through sonic nozzle 52. A suitable plug 84 or, optionally, a valve assembly (not shown), can be attached to the bottom of the condensate leg 82 to allow the leg 82 to be drained at periodic intervals. The provision of a suitable valve assembly (not shown) would be obvious to persons having ordinary skill in this art and, therefore, is not shown or described in further detail.

The digital valve assembly 64 comprises a pneumatically operated valve actuator assembly 69 that is secured to the supply plenum and valve body assembly 40 via a plurality of bolts 70. The pneumatically operated valve actuator assembly 69 includes a piston 68 disposed within a cylinder 66 and suitable pneumatic ports 120 and 122. Air pressure applied to one side of the piston 68 via one such port 120 or 122 while the other side is vented by the other port allows the piston 68 to move in the preferred direction, as is well-known. Therefore, valve actuator assembly 69 controls the position of the pressure balanced piston 76 within sleeve 72 via piston rod 78 to selectively turn on or shut off the flow of natural gas from the intermediate chamber 62 through the outlet port 88. Note that pressure balanced piston 76 includes a plurality of passageways 80 to equalize the pressure on both sides of the piston 76. This pressure equalization is necessary because the natural gas in the intermediate chamber 62 is under relatively high pressure of about 4,000 psig, whereas the compressed air used to actuate the valve actuator assembly 69 is in the range of about 100 psig. If the pressure were not equalized on both sides of piston 76, the high pressure of the natural gas acting on the surface of piston 76 would force the piston and piston rod assembly 78 upward, and the relatively low pneumatic pressure acting on the actuator piston 68 would be unable to move the piston 68 back downward against the high pressure of the natural gas. As a result, the valve assembly comprising piston 76 and sleeve 72 could never be closed. Note also that sleeve 72 has a recessed area 73 extending circumferentially around the sleeve 72 in the area of outlet port 88 to allow natural gas flowing through several radial vent ports 74 in the sleeve 72 to exit through outlet port 88. The pneumatic reservoir 86 contained within the supply plenum and valve body assembly 40 provides a reserve of pneumatic pressure in the event of failure of the pneumatic supply pressure to the valve actuator 69, as will be described in detail below.

The supply plenum and valve body assembly 40 also houses the various pressure and temperature transducers required by the natural gas dispensing system 10 of the present invention. Essentially, the supply plenum 56 is fluidically coupled to a supply stagnation pressure transducer 96 via supply stagnation pressure port 60 (see FIGS. 2 and 4), which senses the supply stagnation pressure $p_1$. Similarly, a temperature probe 58 from a stagnation temperature transducer 118 extends into the natural gas supply plenum 56 to measure the stagnation temperature $T_1$ of the CNG. The stagnation pressure $p_2$ of the CNG in the intermediate chamber 62 is measured by pressure transducer 92 via port 132 (FIG. 4). Finally, a vent pipe 98 and pressure relief valve assembly 99 fluidically coupled to the outlet port 88 via passageway 134 vents natural gas contained within the dispensing hose 28 in the event the pressure in the hose 28 exceeds a predetermined pressure. In the preferred embodiment, the pressure relief valve assembly 99 is set to about 3600 psig. Note also that a second vent pipe 100 and corresponding pressure relief valve assembly 101 are connected to the intermediate chamber of the second channel.

Figure 5:
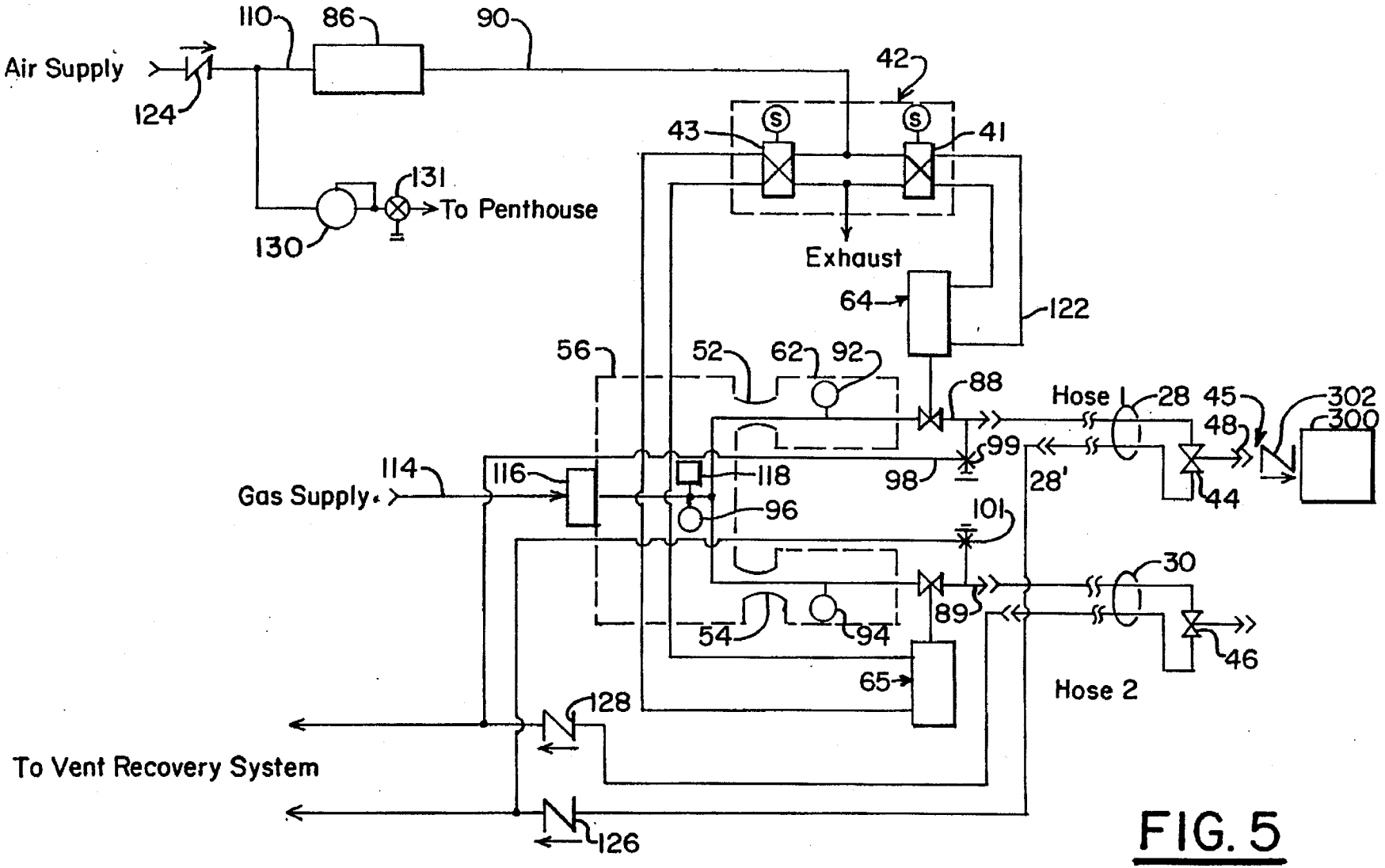
FIG. 5 is a schematic view of the pneumatic system of the present invention showing the pneumatic connections to the control valve assemblies, the locations of the various pressure and temperature transducers, and the path of the natural gas from the supply plenum through the sonic nozzles and ultimately through the hose connections.

The details of the pneumatic system used to control the operation of the valve assemblies 64, 65, as well as the flow of the natural gas through the system and through the hose assemblies 28 and 30 are best understood by referring to FIG. 5. As was briefly described above, the natural gas control valve assemblies 64 and 65 are controlled by a conventional pneumatic system operating with instrument-quality pneumatic air under about 100 psig pressure supplied by a conventional compressor and regulator system (not shown). This pneumatic supply air enters the system through check valve 124 and passes through inlet 110 into pneumatic reservoir 86. See also FIG. 3. A small amount of air is taken off this line 110 and passes through a check valve and purge regulator assembly 130 to maintain the penthouse 14 under a small positive pressure, as will be described below. The pressurized air next passes into storage reservoir 86 out through outlet 90 (FIG. 2) and into the solenoid valve assembly 42, as seen in FIG. 1. Essentially, solenoid valve assembly 42 comprises two conventional electrically operated solenoid valves 41, 43, one for each channel or hose and which solenoid valves are controlled by the electronic control system, as will be described in detail below. Each solenoid valve 41, 43 in solenoid valve assembly 42 operates in a conventional manner. For example, a first solenoid valve 41 in valve assembly 42 is used to selectively reverse the flow to a valve body assembly 64 via inlet lines 120 and 122, therefore selectively opening or closing the digital valve assembly 64. An identical solenoid valve 43 in solenoid valve assembly 42 connected to valve assembly 65 operates the second "channel" i.e., hose 30 of the natural gas dispensing system 10.

As was briefly mentioned above, a purge regulator and check valve assembly 130 is used to supply air under very low pressure, i.e., about one to five inches of water, to the pressure-tight penthouse 14 to ensure that a positive pressure is maintained in the penthouse compartment 14 (which houses all the electronics used by the natural gas dispensing system 10) to eliminate any possibility of natural gas accumulation in the penthouse chamber, possibly leading to an explosion or fire hazard. Also in the preferred embodiment is a pressure relief valve 131, to vent excess pressure from the penthouse in the event of a malfunction of the regulator and check valve assembly 130.

In operation, the supply of CNG connected to the supply plenum and valve assembly 40 enters the supply plenum 56 via input line 114 and inlet filter 116, and the stagnation pressure $p_1$ and the stagnation temperature $T_1$ are sensed by pressure transducer 96 and temperature transducer 118. See also FIG. 4. During the idle loop process 212, described below, the system may be programmed to eliminate the accumulated drift between the supply stagnation pressure transducer 96 and pressure transducer 92. Essentially, the accumulated drift may be eliminated by moving the three way valve 44 to the "vent" position, which closes outlet port 88 at valve 44 and opens the vent conduit 28' to the vehicle tank connection 45 downstream of valve 44 in a conventional manner, and opening valve 64 to equalize the pressure between pressure transducers 96 and 92. The electronic control system then re-calibrates transducer 92 to eliminate any systematic errors that would otherwise occur.

After the vehicle tank 300 is coupled to the dispenser 10 via connection 45, the three-way valve 44 located at the end of the hose assembly 28 is moved to the "fill" position, which closes the vent conduit 28' to the vehicle tank connection 45 and opens the outlet port 88 to the vehicle tank connection 45 in a conventional manner, and the electronic control system then actuates solenoid valve 41, which opens valve 64, to dispense a small amount of CNG into the vehicle tank 300 to open the conventional check valve in the vehicle tank 300 and to ensure that the pressure in the hose 28 is equal to the pressure in the vehicle tank solenoid valve 41 to close valve 64. This initial vehicle tank pressure $p_{v0}$ is sensed by pressure transducer 92 and stored for later use. The control system next opens the valve 64 and dispenses an initial known mass ($m_1$) of CNG into the vehicle tank 300, closes the valve 64 again, and determines the intermediate pressure $p_{v1}$ of the vehicle tank 300 after valve 64 is again closed. The change in vehicle tank pressure, i.e., $p_{v1}-p_{v0}$, is then used to determine the volume v of the vehicle tank 300, according to the well-known state equation:pV=(m/M)RT, or, when solved for vehicle tank volume V:

$$V=\frac{m_1 Z_1 R T_{amb}}{M\left(p_{v1}-p_{v0}\frac{Z_1}{Z_0}\frac{T_1}{T_0}\right)} \tag{3}$$

where:

$m_1$=the initial known mass of the gas;

$Z_i$=the gas compressibility factor at a point i;

R=the universal gas constant;

$T_{amb}$=the ambient temperature;

M=the molecular weight of the gas;

$d_{vi}$=the pressure at a point i; and $T_i$=gas temperature at a point i.

After the volume of the vehicle tank 200 is determined, the control system then calculates the additional mass required ($m_2$) to fill the vehicle tank 300 to the previously calculated cutoff pressure $p_{v\ cutoff}$ using the state equation solved for mass, thus:

$$m_2=\frac{VM}{RT_{amb}}\left(\frac{p_{vcutoff}}{Z_{cutoff}}-\frac{p_{v1}}{Z_1}\right) \tag{4}$$

The system then again opens valve 64 until an amount of $m_2$ of the natural gas has been dispensed into the vehicle tank 300, which will fill the vehicle tank 300 to the cut-off pressure. After this filling process is complete, the operator then moves the three-way valve 44 back to the "vent" position to allow the natural gas contained in the section between the coupler 48 on the end of hose assembly 28 and the connection 45 to the vehicle tank 300 to be evacuated from the system through vent conduit 28' check valve 126 and into the vent recovery system (not shown), where it is recompressed and pumped back into the CNG supply tank (not shown). If this pressurized natural gas is not evaculated from the connection 45 between coupler 48 and the vehicle tank 300, it would be impossible for the user to disconnect the hose 28 from his vehicle, because the extremely high pressure in the connection 45 would prevent the couplers from disconnecting, which is a characteristic of the type of couplers used in this industry.

Figure 6:
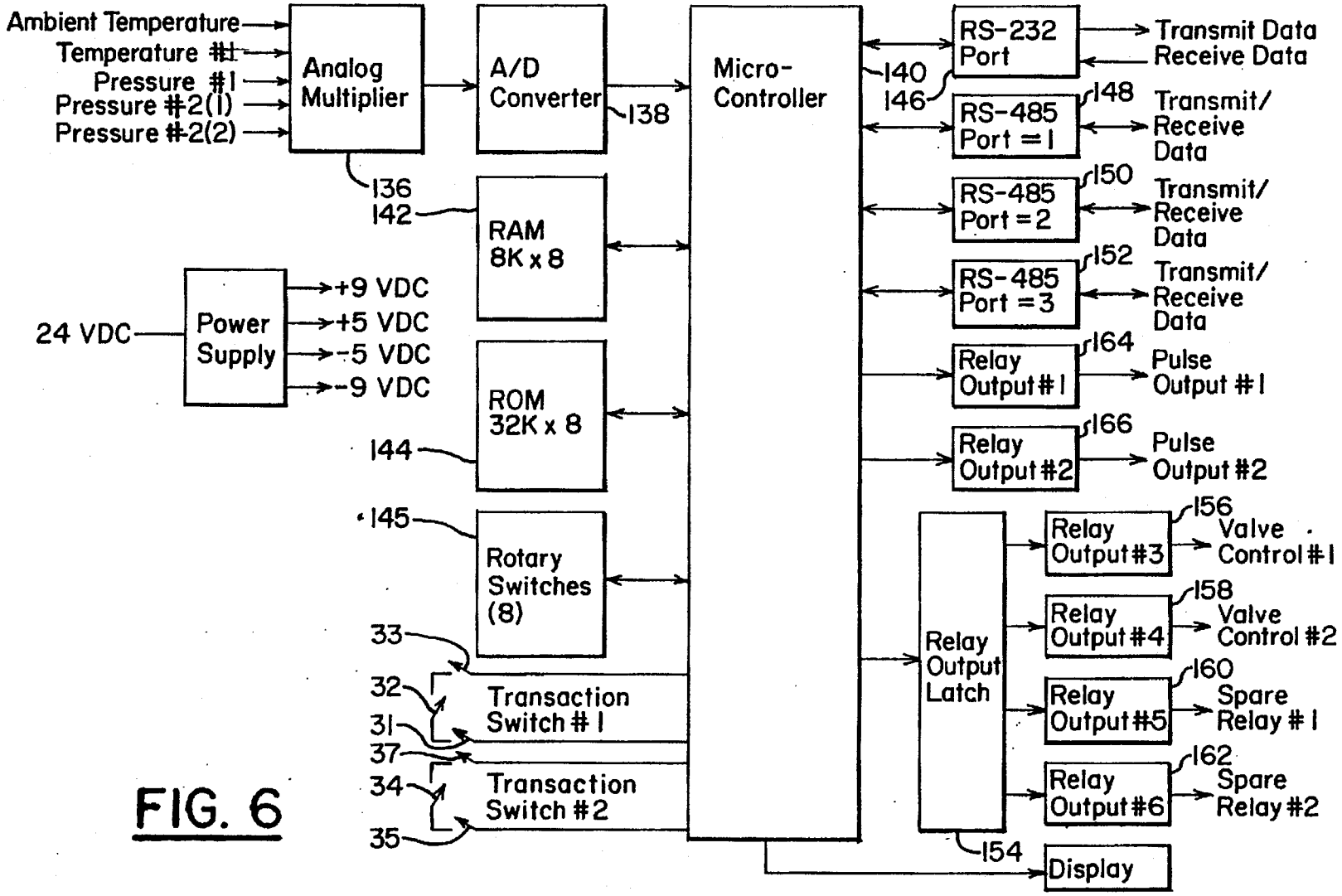
FIG. 6 is a block diagram of the electronic control system used to control the function and operation of the natural gas dispensing system according to the present invention.

The electronic control system used to control the operation of the solenoid valve assembly 42, monitor and determine the pressures and temperature measured by the various transducers as described above, as well as to perform the necessary computations, is shown in FIG. 6. Essentially, the output signals from the various pressure transducers 92, 94, and 96, ambient temperature transducer 91 (FIG. 1), and stagnation temperature transducer 118 are received by analog multiplexer 136, which multiplexes the signals and sends them to an analog to digital (A/D) converter 138. The analog to digital converter 138 converts the analog signals from the various transducers into digital signals suitable for use by the micro-controller or microprocessor 140. In the preferred embodiment, microprocessor 140 is a MC68HC11 manufactured by the Motorola corporation, although other microprocessors could be used with equal effectiveness. Random access memory (RAM) 142 and read only memory (ROM) 144 are also connected to the microprocessor 140 to allow the microprocessor 140 to execute the desired routines at the desired times, as is well-known.

Microprocessor 140 also has inputs for receiving signals from the transaction switches 32 and 34 (see also FIG. 1) for each respective dispensing hose assembly 28, 30. Optionally, a number of authorization switches, such as switches 31, 33, 35, and 37 could be connected in series with switches 32 and 34 to provide additional authorization devices, such as a credit card readers, which must be activated before natural gas will be dispensed, or to provide an emergency shut-off feature by means of a switch (such as 31, 33, 35, or 37) remotely located in the station building.

A series of communication ports 146, 148, 150, and 152 are also connected to microprocessor to 140 for the purposes of transmitting and receiving data, which data may comprise new program information to modify the operation of the dispensing system 10 or may comprise specific authorization and coding data that could be fed to a master control computer remotely located from the dispensing system 10. Since the details associated with such communication ports 146, 148, 150, and 152 are well-known to persons having ordinary skill in the art, and since such persons could easily provide such communications ports depending on the desired configuration and after becoming familiar with the details of this invention, these communications ports 146, 148, 150, and 152 will not be described in further detail. Similarly, two relay outputs 164, 166 are used to send pulse data to optionally connected card readers (also not shown), as is also well-known.

A relay output latch 154 is also connected to the microprocessor 140 and multiplexes signals to relay outputs 156 and 158 which control the solenoid valves 41 and 43 for hose assemblies 28 and 30, respectively. Two spare relays 160 and 162 are also connected to relay output latch 154 and may be used to control other various functions not shown and described herein. Finally, in the preferred embodiment eight (8) rotary switches 145 are also connected to microprocessor 140 to allow the user to configure the microprocessor 140 to his particular requirements. Again, since such configuration-selectable features may vary depending on the particular use desired and microprocessor, and since it is well-known to provide for such user selectable features, the details of the rotary switches 145 will not be described in further detail.

Figure 8:
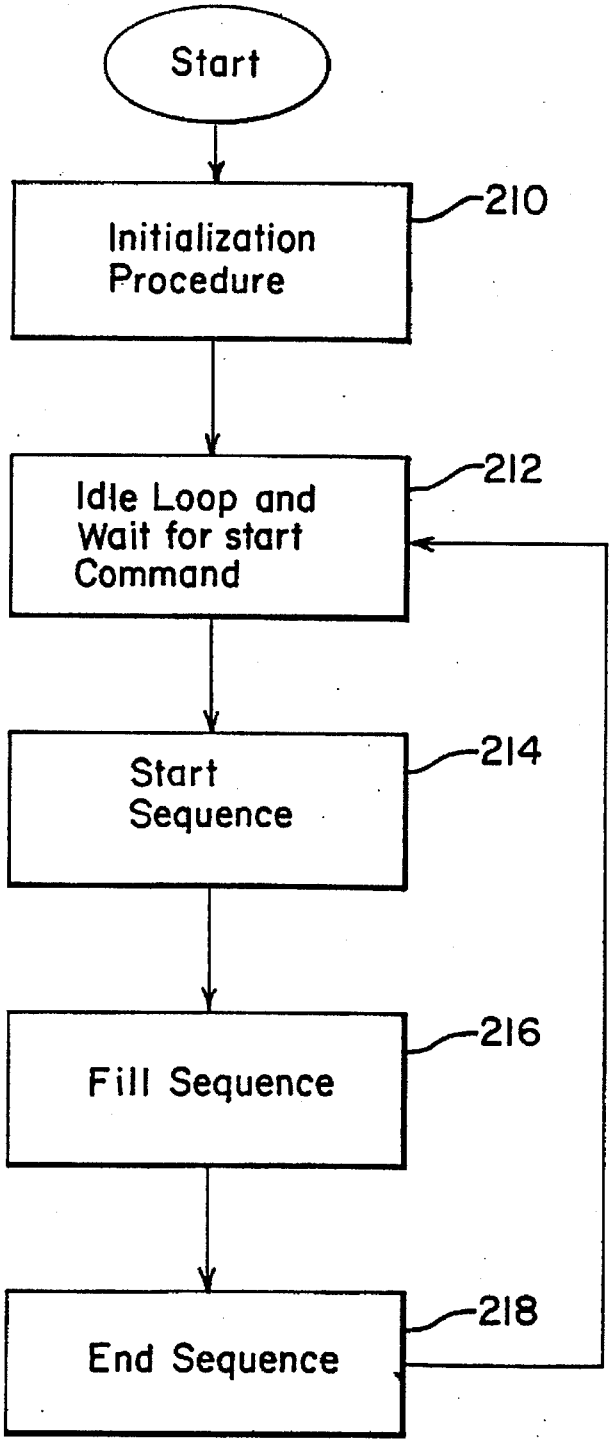
FIG. 8 is a flow chart showing the steps executed by the electronic control system of the present invention.
Figure 10A:
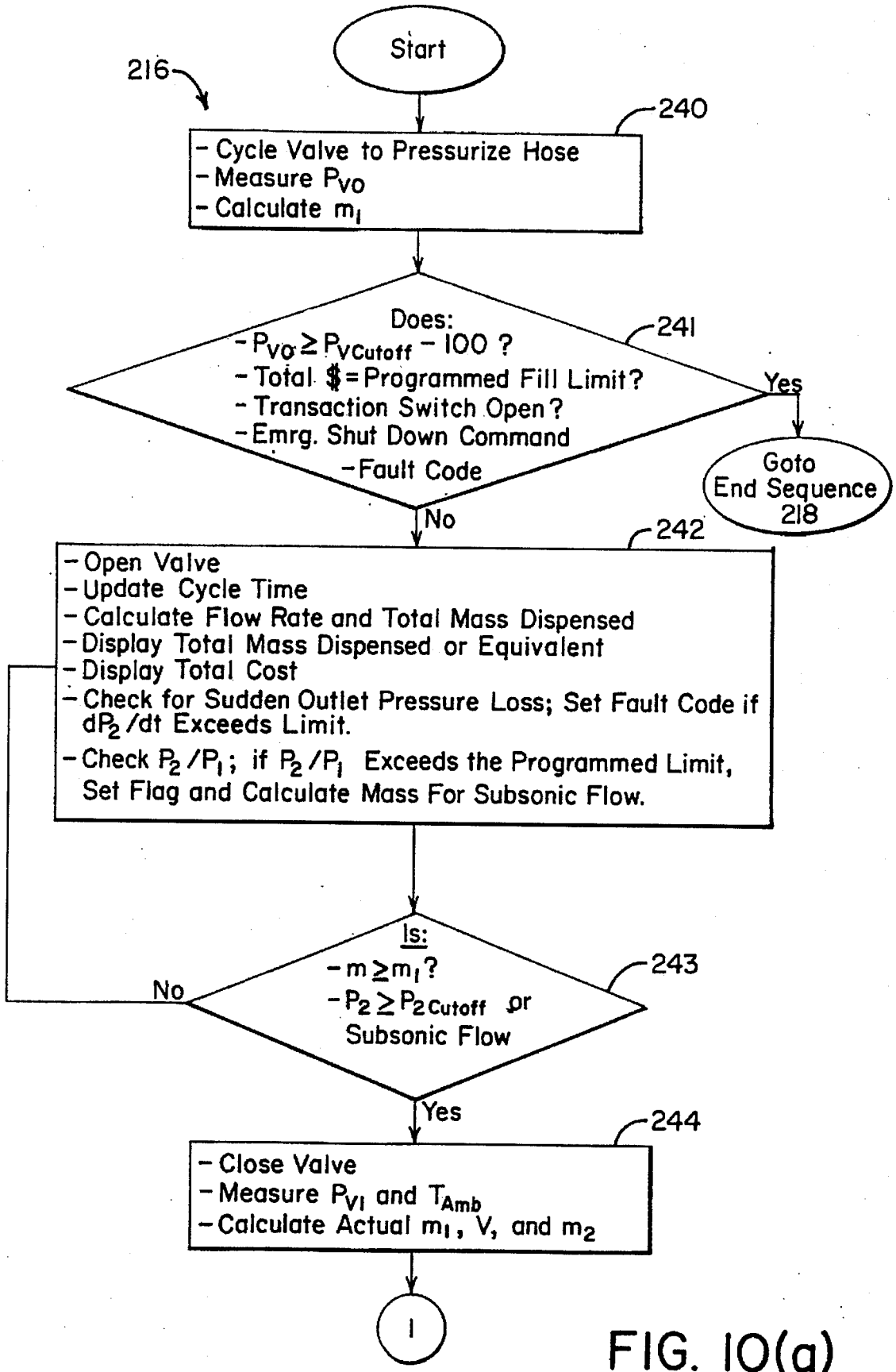
FIG. 10(*a*) is a flow chart showing the detailed steps of the Fill Sequence of FIG. 8.
Figure 10B:
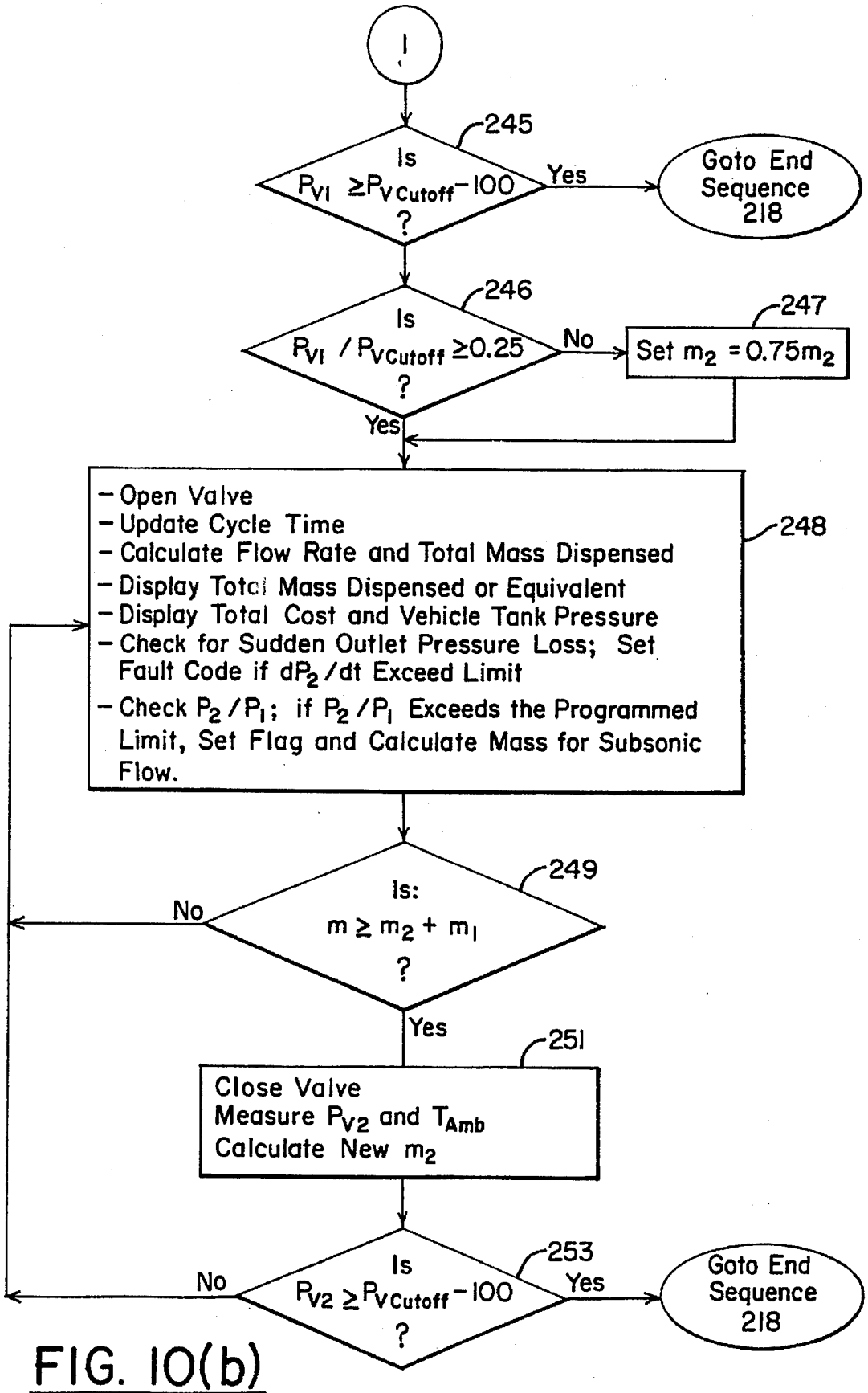

The details of the processes executed by the microprocessor 140 during operation of the dispensing system 10 are best been by referring to the flow diagrams shown in FIGS. 8, 9, 10(*a*), 10(*b*), and 11. However, processes executed by the microprocessor 140 will be understood more easily by first describing the overall theory and operation of the mass-based filling process used by the present invention.

Figure 7:
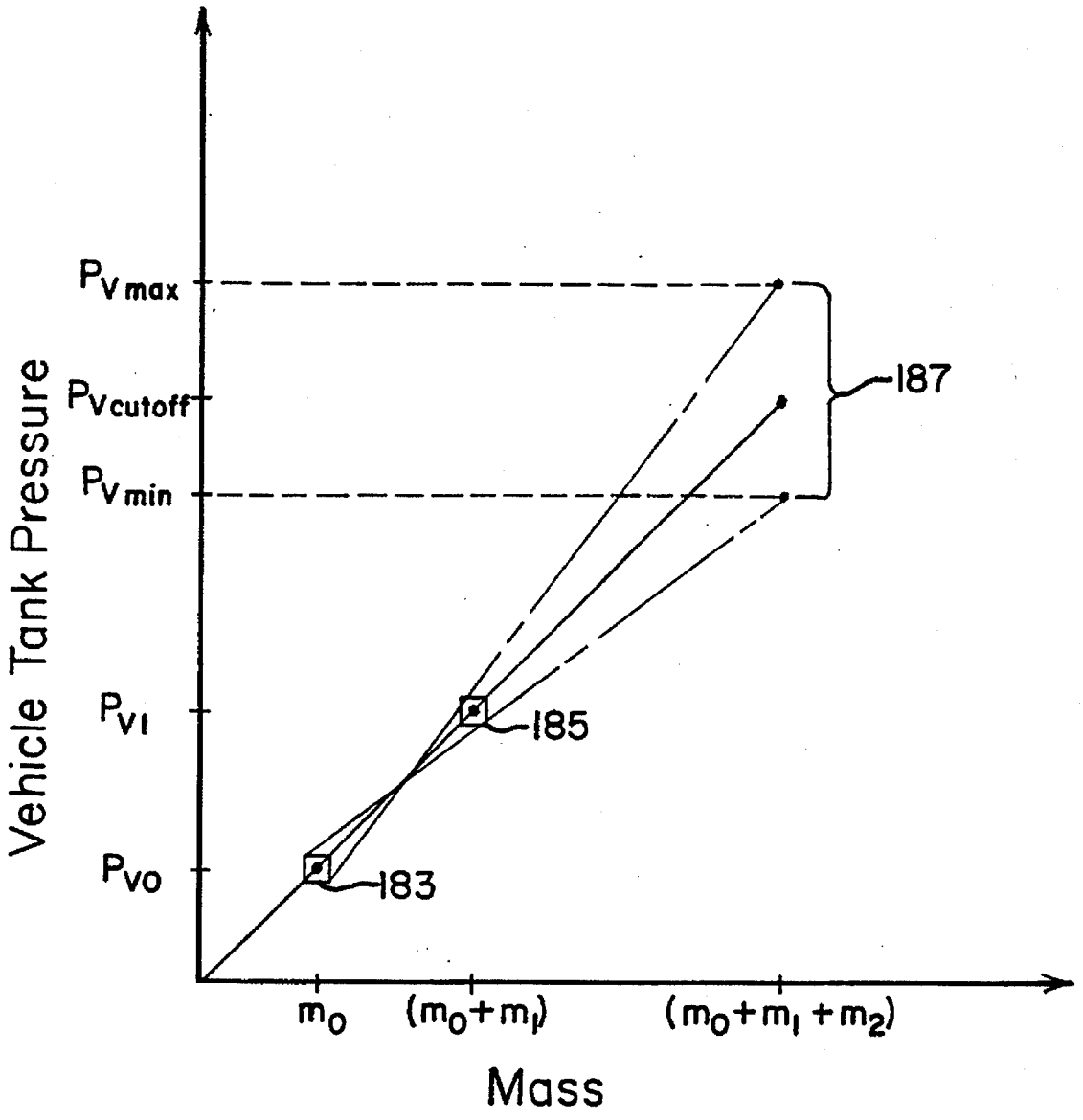
FIG. 7 is a graph of vehicle tank pressure vs. mass of CNG.

As best seen in FIG. 7, the stagnation pressure in the vehicle tank 300 is linearly related to the mass of gas in the vehicle tank 300 (neglecting compressibility and at constant temperature). As discussed above, many factors, such as frictional effects or sonic choke points, may make it difficult, if not impossible, to use a remotely located sensor upstream of the dispensing hose to accurately measure the pressure of the vehicle tank 300 while it is being filled. To solve these problems the present invention first determines the volume V of the vehicle tank 300 and then calculates the additional mass of CNG that is required to increase the pressure of the vehicle tank 300 to the previously calculated cut-off pressure $p_{v\ cutoff}$. The system of dispenser 10 then simply dispenses the additional mass of CNG into the vehicle tank 300, thus insuring that the vehicle tank 300 is always filled to the cut-off pressure regardless of the pressure drop in the dispensing hose 28 and regardless of whether a sonic choke point exists in the dispensing host 28 or connection 45 between the vehicle tank 300 and the pressure transducer 92'.

Briefly, the fill method of the present invention first quickly cycles valve 64 to pop open and safety check valve 302 of vehicle tank 300 and equalizer the pressure in the dispensing hose 28 and vehicle tank 300. After valve 64 has closed, the initial vehicle tank 300 pressure $p_{v0}$ can be accurately sensed by transducer 92, since there is no CNG flow through the dispensing hose 28. The initial vehicle tank pressure $p_{v0}$ corresponds to an initial mass $m_0$ of CNG already in the vehicle tank 300, as seen in FIG. 7. The system then adds an initial known mass ($m_1$) of gas to the vehicle tank 300, thus increasing the vehicle tank pressure to an intermediate pressure of $p_{v1}$. Equation (3) above can now be used to determine the volume v of the vehicle tank 300. Once the vehicle tank volume v has been determined, Equation (4) is used to determine the additional mass ($m_2$) of natural gas (CNG) required to increase the pressure in the vehicle tank 300 to the previously calculated cut-off pressure $p_{v\ cutoff}$.

Unfortunately, there will always be a certain amount of uncertainty in the measured valves of $p_{v0}$ and $p_{v1}$, as represented by the error boxes 183 and 185 (FIG. 7), which will result in an error 187 in achieving the desired cut-off pressure $p_{v\ cutoff}$ by the addition of mass $m_2$ of CNG. Therefore, the present invention also includes suitable safeguards to ensure that the pressure error will never exceed $p_{v\ max}$ or fall below $p_{v\ min}$. More specifically, while the size of the error band 187 can be reduced by using precision pressure transducers to determine the pressure, even the best transducers will have some uncertainty. Therefore, the method of the present invention limits the maximum extrapolation permitted in calculating the additional mass ($m_2$) required to reach the cut-off pressure. If the intermediate $p_{v1}$ of the vehicle tank 300 is less than ¼ of the final pressure cutoff, i.e., if $p_{v1}/p_{v\ cutoff} \geq 0.25$, then the method of the present invention will reduce the calculated value of the additional mass $m_2$ to 75% of its original value to avoid overshooting the cut-off pressure. Then, after the reduced mass $m_2$ is added, the valve 84 is closed and a new vehicle tank pressure $p_{v2}$ is determined. The new vehicle tank pressure $p_{v2}$ is then used to recompute a new additional mass $m_3$ required to fill the vehicle tank 300 to the cut-off pressure $p_{v\ cutoff}$.

Referring now to FIG. 8, the steps performed by the microprocessor 140 are as follows. When power is initially applied to the natural gas dispensing system 10, the microprocessor 140 executes an initialization procedure 210, which serves to clear all fault flags, blank out and turn on the displays, and perform various diagnostic tests on the microprocessor 140, the random access memory 142, and the read only memory 144. Since such initialization and diagnostic test procedures 210 are well-known in the art and are usually dependent on the particular hardware configuration being used, the precise details of these initialization and diagnostic procedures will not be explained in further detail.

After the initialization procedure 210 has been completed, the program flow continues to the idle loop and wait for start command process 212. Essentially, this process 212 places the dispensing system 10 in idle state, whereby the microprocessor 140 awaits input from one of the transaction switches 32 or 34 to signal that the operator wishes to begin dispensing natural gas. If the microprocessor 140 receives a signal from one of the transaction switches 32 or 34, the microprocessor 140 will proceed to the start sequence procedure 214. In this start sequence procedure 214, the microprocessor 140 executes a number of predetermined steps to measure and calibrate the pressures and temperatures received form the various pressure and temperature transducers connected to the supply plenum and valve assembly 40. The start sequence procedure 214 also calculates the vehicle tank cut-off pressure, $p_{v\ cutoff}$, based on the ambient temperature $T_{amb}$, and data stored in the ROM relating to the rated pressure of the vehicle tank 300, as will be described below. After the start sequence procedure 214 is complete, the microprocessor proceeds to the fill sequence process 216. The fill sequence 216 performs all of the necessary steps to completely fill the natural gas storage tank 300 in the vehicle including the steps of initially cycling the valve 64 to pressurize the dispensing hose 26, measuring the initial vehicle tank pressure $p_{v0}$, calculating the volume v of the vehicle tank 300 and the mass of CNG required to fill the vehicle tank 300 to the cut-off pressure $p_v$ cut-off, and, of course, automatically shutting off the flow of natural gas when the vehicle tank 300 has been filled to the previously calculated cut-off pressure. After the fill process is complete, the microprocessor 140 will next execute the end sequence process 218 to complete the transaction process and return the system 10 to the idle state 212.

The details of the start sequence 214 are best seen in FIG. 9. The process begins by executing 220 to clear all channel-specific fault flags and wait for an authorization code from a host computer system, if one is provided. The process next proceeds to 222 which begins by clearing any transaction totals from a previous filling operation and turns on the display segments to indicate to the user that the electronic control system is active and proceeding with the filling process. Also during the step 222, the computer measures and stores values for $p_1$ and $p_2$ as sensed by upstream transducer 96 and downstream transducer 92, respectively. Since the valve 64 is not yet open, the pressures sensed by transducers 92 and 96 are identical, as mentioned above. The ambient temperature $T_{amb}$ sensed by transducer 91 is also measured and stored at this time. Step 222 next calculates a cut-off pressure limit $p_{v\ cutoff}$ as a function of the previously measured $T_{amb}$ and the predetermined tank pressure limit that was previously programmed into the microprocessor 140 in accordance with well known gas relations. Finally, the process 222 resets a state timer to zero seconds. Next, the microprocessor 140 executes processes 224, 226 and 228. Essentially, these processes measure and store the values detected for $p_1$ and $p_2$ three (3) additional times, with at least one second interval between measuring periods to insure that the pressures have stabilized and to compensate for the fact that the A/D converter 138 cannot convert the signals from the pressure transducers on a real time basis. Of course, if a real time A/D converter were used, then it would not be necessary to wait one second between readings. In step 228, the pressure transducer 92 ($p_2$) is calibrated by summing the earlier measurements for $p_1$ and subtracting the sum of the measurements from $p_2$ and dividing by 4. This value is then stored by the microprocessor 140, which adds it to all subsequent pressure readings from transducer 92 to eliminate systematic errors. Finally, this process 228 sets a fault flag if the calibrated value for $p_2$ (i.e., transducer 92) exceeds a predetermined limit, indicating a fault in the system or a defective transducer.

Start sequence step 214 next executes process 230 which re-checks the position of the transaction switch. If the transaction switch has been opened, the process will go back to the idle loop step 212. If the transaction switch is still closed, the microprocessor 140 will open the natural gas valve 64 and set the transaction time equal to the open valve response time. The reason that the transaction time is set to the open valve response time (in the preferred embodiment the open valve response time is about 0.1 second) is because in the preferred embodiment it takes about 0.1 second before sonic flow is established in the sonic nozzle 52. Note that this open valve response time is dependent on the particular nozzle and valve configuration employed and is determined for a particular set-up on an experimental basis, and the amount of natural gas that flows through the nozzle during this time will be added to the total amount of CNG dispensed. Finally, the start sequence process 214 executes step 232 which updates the transaction time and determines whether the transaction time is greater than the predetermined stabilization time. In the preferred embodiment, the stabilization time is approximately one second and is used because the analog to digital converter 138 connected to the microprocessor 140 does not operate on a real time basis, i.e., the A/D converter 138 is relatively slow and is only capable of updating the data received from the various transducers about every 0.3 to 0.4 seconds. Therefore, the microprocessor 140 will wait until the transaction time has exceeded the stabilization time before proceeding with the fill sequence process 216.

Referring now to FIGS. 10(*a*) and 10(*b*), fill sequence 216 begins with step 240 which briefly cycles the valve 64 to dispense a small amount of CNG into the vehicle tank and briefly pop open any check valves 302 in the vehicle tank 300, thus equalizing the pressure in the dispensing hose 28 with the pressure in the vehicle tank 300. Step 240 also determines the initial tank pressure $p_{v0}$ and estimates an initial fill mass $m_1$ based on the difference between the initial tank pressure $p_{v0}$ and the previously calculated cut=off pressure $p_{v\ cutoff}$ to ensure that the cut-off pressure will not be exceeded by adding the initial mass $m_1$.

Fill sequence 216 next executes step 241, which controls the exact process by which the vehicle tank 300 is filled. For example, before the dispensing process is initiated, the microprocessor 140 checks to see whether the initial vehicle tank pressure $p_{v0}$ is within 100 psig of the calculated cutoff pressure $p_{v\ cutoff}$. If so, the vehicle tank 300 is considered to be essentially full, and the process goes to the end sequence 218 to abort the fill process. Also, as shown at step 241 the user can input a total dollar amount of natural gas to be dispensed into his vehicle tank 300. In any event, process 241 forms one step in a loop that continuously determines whether the total dollar amount equals the preprogrammed fill limit or whether the vehicle tank 300 is to be filled to the previously calibrated cut-off pressure $p_{v\ cutoff}$ calculated in step 222 (see FIG. 9). Finally, step 241 also continually checks to insure that the transaction switch is still closed and that the computer has not received any emergency shutdown commands from an outside host computer or a fault code generated within the microprocessor 140 itself. If none of these events occur, the process proceeds to step 242 which first updates the cycle time and then is set to calculate the flow rate and actual total mass M of CNG dispensed in real time during the succeeding steps of the process for display on the window 140. This actual total mass M dispensed is also used to calculate total price of the CNG dispensed in real time for display on the window 136. Optionally data output pulses indicative of this total mass M and total price tally may be sent to a card reader (not shown) and, in any even, the display will continually be updated in with the real time total mass actual M of CNG dispensed (or equivalent) and the total cost. Also during this process 242, the system continually monitors the time variation of the discharge pressure $dp_2/dt$ exceeds a certain predetermined limit, indicating a sudden loss of outlet pressure, such as would result from a ruptured dispensing hose, the computer will automatically set a fault code and immediately turn off the flow of CNG. Finally, this process 242 continually checks the ratio of the discharge pressure $p_2$ against the supply pressure $p_1$. If this ratio exceeds the preprogrammed limit (0.82 in the preferred embodiment), the computer will also set a flag. The reason a flag is set in this case is that if the ratio of $p_2$ to $p_1$ exceeds a certain limit, sonic flow will no longer be maintained and the sonic nozzle 52 and the mass flow calculations will no longer be correct. In that case, the microprocessor 140 will automatically calculate the mass flow rate for subsonic nozzle conduits, as explained above. Process 242 is repeated until one of the conditions in step 243 is satisfied i.e., the initial mass M, is dispensed into the vehicle tank 300, the pressure in the hose 28 reaches the cutoff pressure, or the flow is subsonic. The process then proceeds to step 244, which closes the valve 64, measures the intermediate pressure $p_{v1}$ and $T_{amb}$, calculates the actual amount of initial mass ($m_1$) dispensed in the first increment of the fill, as well as the vehicle tank volume V and additional mass ($m_2$) required to fill the vehicle tank to the cut-off pressure $p_v$, cut-off as determined by Equations (3) and (4), respectively.

Process 246 next determines whether the intermediate pressure $p_{v1}$ is within 100 psig of the previously determined cut-off pressure $p_{v\ cutoff}$. If so, the vehicle tank 300 is considered to be essentially full, and the process executes the end sequence 218. If not, the process proceeds to step 246 which determines whether the vehicle tank 300 is more than one quarter (¼) full (on a pressure basis). If the vehicle tank 300 is more than ¼ full, the process proceeds to stop 248. However, if the vehicle tank 300 is less then ¼ full, then the next additional mass $m_2$ to be dispensed is reduced to 75% of its original value before proceeding to step 248. As mentioned above, this process 246 minimizes the chances for vehicle tank 300 overfilling due to uncertainties in the measured values for the vehicle tank 300 pressure. Step 248 is identical to step 242 and, therefore, will not be described again. Process 248 is repeated until the condition in step 249 is satisfied i.e., the actual mass M dispensed reaches the sum of the first increment of mass M, dispensed plus the additional mass $M_2$. The process then proceeds to step 251 which closes the valve 64, measures the new intermediate tank pressure $p_{v2}$, $T_{amb}$, and calculates the actual amount of additional mass ($m_2$) dispensed into the vehicle tank 300. Finally, step 253 checks to see whether the vehicle tank pressure is within 100 psig of the calculated cut-off pressure. If it is, the tank 300 is considered to be full, and the process executes the end sequence process 218. If not, the vehicle tank 300 is still not filled, a new mass ($m_3$) is calculated based on the new intermediate tank pressure $p_{v2}$ and the process 248 is repeated again and, if necessary, again and again until a new actual vehicle tank pressure $p_{v3}$ after dispensing the additional mass $M_3$ or a new actual tank pressure $p_{vn}$ after dispensing an additional mass $M_n$ gets within 100 psig of the cutoff pressure $p_{v\ cutoff}$ ad indicated at step 253. Then, the process goes to the end sequence 218.

Figure 11:
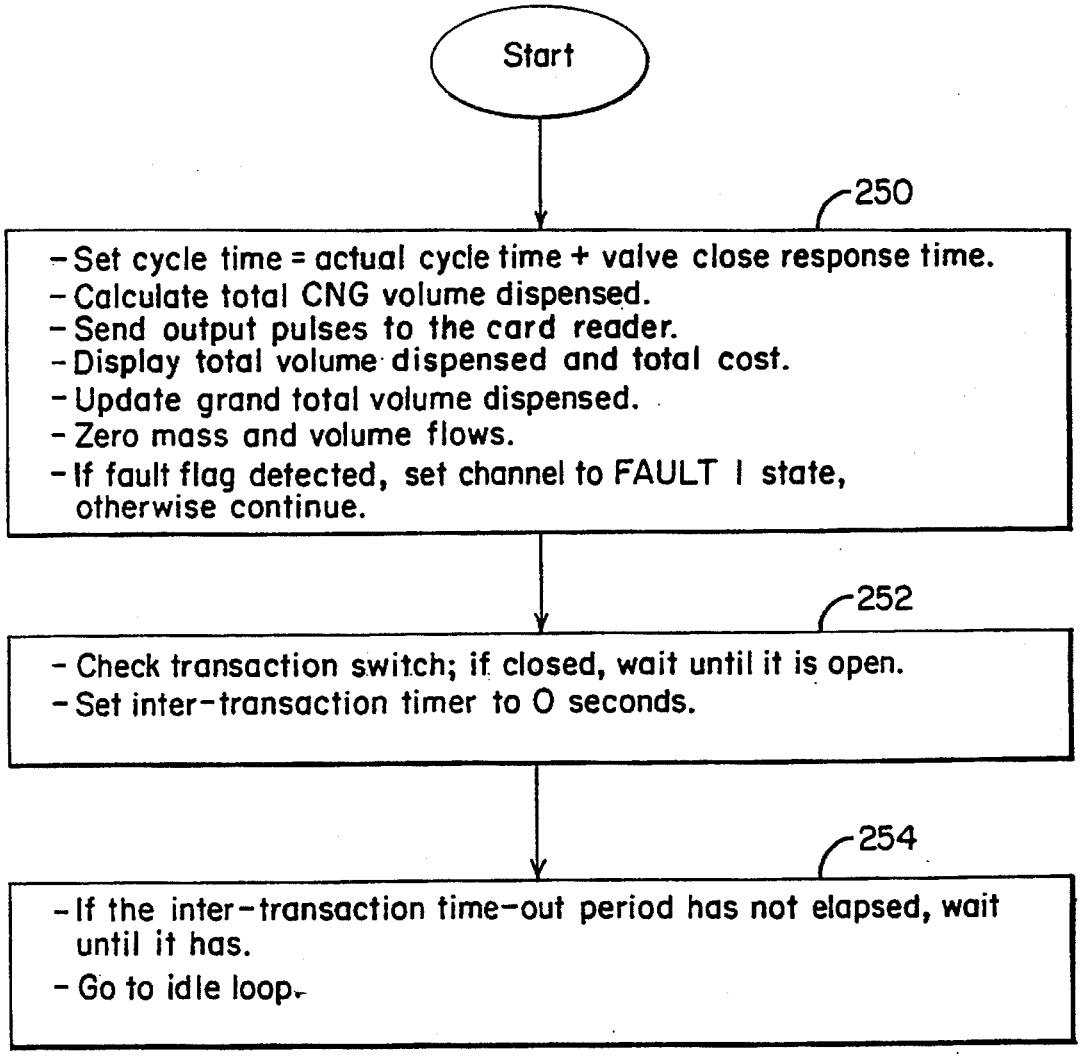
FIG. 11 is a detailed flow chart showing the steps of the End Sequence of FIG. 8.

The detailed steps of the end sequence process 218 are shown in FIG. 11. This process 218 begins by executing step 250 which sets the total cycle or transaction time to equal the actual measured cycle time plus the valve close response time, which, in the preferred embodiment is about 0.25 seconds. Here again, the valve close response time is added to the total cycle time because the A-D converter 138 cannot convert data on a real time basis. Next, the total amount of compressed natural gas dispensed is calculated based on the total cycle time and in accordance with the preprogrammed relation for mass flow through the sonic nozzle, both when the flow was choked and when it was not chocked (i.e., subsonic), plus the small amount of neutral gas that flows through the nozzle during the valve opening and closing times. Output pulses are again sent to a card reader (not shown) and the total volume dispensed and the total cost are displayed on displays 140 and 136. Optionally, the discharge pressure $p_2$ can be displayed on display 138. Process 250 then updates the grand total of the volume of compressed natural gas dispensed from the system for accounting purposes and the mass and volume flows are zeroed by the computer. If any fault flag was detected, the computer will set the specific channel in which the fault flag was detected to a fault state. The process 218 next executes step 252 which continually monitors the condition of the transaction switch. If the switch is closed, the process will remain at this step until the user opens the switch indicating that the fill process is complete. Process 252 then sets the inter-transaction timer to zero seconds. Finally, the process 218 executes step 254 which waits until the inter-transaction time-out period has elapsed. Once the time-cut period has elapsed, the process will return to the idle loop 212 and the dispensing process can be initiated again by a new customer.

This completes the detailed description of the natural gas dispensing system 10 according to the present invention. While some of the obvious and numerous modifications and equivalents have been described herein, still other modifications and changes will readily occur to those having ordinary skill in the art. For example, none of the sealing devices required by this invention have been shown and described herein, as it is well-known to provide various types of seals, such as "O" ring type seals, to prevent the CNG from leaking, and persons having ordinary skill in this art could readily provide such seals after becoming familiar with the details of the present invention.

Further, while this invention has been shown and described to dispense compressed natural gas, other fluids could just as easily be used with a system according to the present invention with little or no modification. For instance, the dispensing system shown and described herein could also be used to dispense hydrogen or propane gas. Moreover, more than two sonic nozzles could be connected to the supply plenum to provide an increased number of dispensing hoses from a single dispenser body or plenum. Finally, numerous enhancements of the operating program are possible by reprogramming the microprocessor to make the appropriate enhancements, as would be obvious to those persons having ordinary skill in the art.

The foregoing is considered as illustrative only of the principles of this invention. Further, since numerous modifications and changes will readily occur to those skilled in the art, it is not desired to limit the invention to the exact construction and operation shown and described, and accordingly, all suitable modifications and equivalents may be considered as falling within the scope of the invention as defined by the claims which follow.

The embodiments of the invention in which an exclusive property or privilege is claimed are defined as follows:

1. Apparatus capable of dispensing and measuring quantities of natural gas into a plurality of separate tanks, comprising:

a plenum that is of sufficient size to contain a volume of the natural gas being dispensed in substantially stagnant pressure condition;

a first conduit connecting said plenum in fluid flow relationship to a first tank;

a second conduit connecting said plenum in fluid flow relationship to a second tank;

a first valve positioned in said first conduit, said first valve being selectively openable and closeable to selectively allow or prevent flow of natural gas from said plenum to said first tank;

a second valve positioned in said second conduit, said second valve being selectively openable and closeable to selectively allow or prevent flow of natural gas from said plenum to said second tank;

a first sonic nozzle positioned in said first conduit, said first sonic nozzle having a first converting section that starts in said plenum and converges to a first throat that has a cross-sectional area for choking flow of natural gas from said plenum at sonic velocity, and a first diverging section that diverges from said first throat;

a second sonic nozzle positioned in said second conduit, said second sonic nozzle having a second converging section that starts in said plenum and converges to a second throat that has a cross-sectional area for choking flow of natural gas from said plenum at sonic velocity, and a second diverging section that diverges from said second throat;

natural gas pressure supply means connected in fluid flow relationship to said plenum for supplying natural gas to said plenum under sufficient pressure to cause the natural gas to flow at sonic choked velocity in said first sonic nozzle when said first valve is open and to cause the natural gas to flow at sonic choke velocity in said second sonic nozzle when said second valve is open;

a timer that is capable of measuring time that said first valve is open and that is capable of measuring time that said second valve is open;

pressure measuring means in the plenum for measuring stagnant pressure of the natural gas in said plenum when the first valve is open and when the second valve is open;

temperature measuring means in the plenum for measuring temperature of the natural gas in said plenum when the first valve is open and when the second valve is open; and microprocessor means connected to said timer means, to said pressure measuring means, and to said temperature measuring means for:

(i) calculating quantity or natural gas dispensed through said first conduit by multiplying the time that the first valve is actuated to open times mass flow rate $\dot{m}$ of natural gas flowing through said first throat, when this $\dot{m}$ is determined according to the formula:

$$\dot{m} = C_d \frac{kAp_1}{\sqrt{T_1}}$$

where $C_d$ is the nozzle discharge coefficient for said first sonic nozzle, k is a constant depending on ratio of specific heat and gas constant of the natural gas, A is the cross-sectional area of the first throat, $p_1$ is the stagnation pressure of the natural gas in the plenum measured by said pressure measuring means, and $T_1$ is the temperature of the natural gas in the plenum measured by said temperature measuring means; and (ii) calculating quantity of natural gas dispensed through said second conduit by multiplying the time that the second valve is open times mass flow rate $\dot{m}'$ of natural gas flowing through said second throat, where $\dot{m}'$ is determined according to the formula:

$$\dot{m}' = C_d' \frac{kA'p_1}{\sqrt{T_1}}$$

where $C_d'$ is the nozzle discharge coefficient for said second nozzle, k is a constant depending on ratio of specific heat and gas constant of the natural gas, a' is the cross-sectional area of the second throat, $p_1$ is the stagnation pressure of the natural gas in the plenum measured by said pressure measuring means, and $t_1$ is the temperature of the natural gas in the plenum measured by said temperature measuring means.

2. The apparatus of claim 1, including a first valve controller that actuates said first valve to open and close and a second valve controller that actuates said second valve to open and close, said timer being connected to said first valve controller to measure the time that the first valve is open, and said timer being connected to said second valve controller to measure the time that the second valve is open.

3. A method of dispensing and measuring a first quantity of natural gas into a first tank and also dispensing and measuring a second quantity of natural gas into a second tank, comprising the steps of:

connecting a supply of natural gas to a plenum that is of sufficient size to maintain substantially stagnant pressure while the natural gas flows through the plenum to the first tank and to the second tank;

connecting a first conduit between said plenum and said first tank, with said first conduit containing a first sonic nozzle with a first converging section that starts at a first mouth in said plenum and converges to a first throat that has a cross-sectional area a and then diverges, such that natural gas can flow from said plenum, through said first conduit, including through said first sonic nozzle, to the first tank;

connecting a second conduit between said plenum and said second tank, with said second conduit containing a second sonic nozzle with a second converging section that starts at a second mouth in the said plenum and converges to a second throat that has a cross-sectional area A' and then diverges, such that natural gas can flow from said plenum, through said second conduit, including through said second sonic nozzle, to the second tank;

flowing natural gas from the natural gas supply source, through the plenum, and into said first mouth of said first sonic nozzle for a time t and under sufficient pressure to produce sonic velocity choked flow of natural gas in said first throat, and flowing natural gas from the natural gas supply source, through the plenum, and into said second mouth of said second sonic nozzle for a time t', at lease part of which time t' is concurrent with the time t and under sufficient pressure to produce sonic velocity choked flow of natural gas in said second throat;

measuring the respective times t and t', measuring stagnation pressure $p_1$ in the plenum as the natural gas flows through the plenum, and measuring temperature $T_1$ of the natural gas as the natural gas flows through the plenum;

determining the quantity of natural gas dispensed into the first tank by multiplying the time t times mass flow rate $\dot{m}$ of the natural gas flowing in the first throat, which $\dot{m}$ is determined by the formula:

$$\dot{m} = C_d \frac{kAp_1}{\sqrt{T_1}}$$

where $C_d$ is a discharge coefficient for the first sonic nozzle and k is a constant depending on ratio of specific heat and gas constant of the natural gas; and determining the quantity of natural gas dispensed into the second tank by multiplying the time t' times mass flow rate $\dot{m}'$ of the natural gas flowing in the second throat, which $\dot{m}'$ is determined by the formula:

$$\dot{m}' = C_d' \frac{kA'p_1}{\sqrt{T_1}}$$

where $C_d'$ is a discharge coefficient for the second nozzle and k is a constant depending on the ratio of specific heat and gas constant of the natural gas.

4. Apparatus capable of dispensing and measuring quantities of natural gas into a tank, comprising:

a plenum that is of sufficient size to contain a volume of the natural gas being dispensed in substantially stagnant pressure condition;

a first conduit connecting said plenum in fluid flow relationship to a tank;

a valve positioned in said conduit, said valve being selectively openable and closeable to selectively allow or prevent flow of natural gas from said plenum to said tank;

a sonic nozzle positioned in said conduit, said sonic nozzle having a converging section that starts in said plenum and converges to a throat that has a cross-sectional are for choking flow of natural gas from said plenum at sonic velocity, and a diverging section that diverges from said throat;

natural gas pressure supply means connected in fluid flow relationship to said plenum for supplying natural gas to said plenum under sufficient pressure to cause the natural gas to flow at sonic choked velocity in said sonic nozzle when said valve is open;

a timer that is capable of measuring time that said valve is open;

pressure measuring means in the plenum for measuring stagnant pressure of the natural gas in said plenum when the valve is open;

temperature measuring means in the plenum for measuring temperature of the natural gas in said plenum when the valve is open; and microprocessor means connected to said timer means, to said pressure measuring means, and to said temperature measuring means for calculating quantity of natural gas dispensed through said conduit by multiplying the time that the valve is actuated to open times mass flow rate $\dot{m}$ of natural gas flowing through said throat, where this $\dot{m}$ is determined according to the formula:

$$\dot{m} = C_d \frac{kAp_1}{\sqrt{T_1}}$$

where $C_d$ is the nozzle discharge coefficient for said sonic nozzle, k is a constant depending on ratio of specific heat and gas constant of the natural gas, a is the cross-sectional area of the throat, $p_1$ is the stagnation pressure of the natural gas in the plenum measured by said pressure measuring means, and $T_1$ is the temperature of the natural gas in the plenum measured by said temperature measuring means.

5. The apparatus of claim 4, including a valve controller that actuates said valve to open and close, said timer being connected to said valve controller to measure the time that the valve is open.

6. A method of dispensing and measuring a quantity of natural gas into a tank, comprising the steps of:

connecting a supply of natural gas to a plenum that is of sufficient size to maintain substantially stagnant pressure while the natural gas flows through the plenum to the tank;

connecting a conduit between said plenum and said tank, with said conduit containing a sonic nozzle with a converging section that starts at a mouth in said plenum and converges to a throat that has a cross-sectional area A and then diverges, such that natural gas can flow from said plenum, through said conduit, including through said sonic nozzle, to the tank;

flowing natural gas from the natural gas supply source, through the plenum, and into said mouth of said sonic nozzle for a time t and under sufficient pressure to produce sonic velocity choked flow of natural gas in said throat;

measuring the time t, measuring stagnation pressure $p_1$ in the plenum as the natural gas flows through the plenum, and measuring temperature $T_1$ of the natural gas as the natural gas flows through the plenum; and determining the quantity of natural gas dispensed into the tank by multiplying the time t times mass flow rate $\dot{m}$ of the natural gas flowing in the throat, which $\dot{m}$ is determined by the formula:

$$\dot{m} = C_d \frac{kAp_1}{\sqrt{T_1}}$$

where $C_d$ is a discharge coefficient for the first sonic nozzle and k is a constant depending on ratio of specific heat and gas constant of the natural gas.

* * * * *